US005465583A

United States Patent [19]

Goode

[11] Patent Number: 5,465,583

[45] Date of Patent: Nov. 14, 1995

[54] LIQUID METHANE FUELING FACILITY

[75] Inventor: John E. Goode, Arlington, Tex.

[73] Assignee: Hydra Rig, Inc., Fort Worth, Tex.

[21] Appl. No.: 108,882

[22] Filed: Aug. 18, 1993

Related U.S. Application Data

[63] Continuation-in-part of Ser. No. 7,540, Jan. 22, 1993, Pat. No. 5,360,139.

[51] Int. Cl.[6] ..... F17C 7/02; F17C 13/02; B65B 31/00

[52] U.S. Cl. ..... 62/50.2; 62/49.1; 62/50.1; 141/4

[58] Field of Search ..... 62/7, 47.1, 48.2, 62/49.1, 50.1, 50.2; 123/525, 527; 141/4

[56] References Cited

U.S. PATENT DOCUMENTS

| | | | |
|---|---|---|---|
| 2,402,355 | 6/1946 | Whaley, Jr. | 62/49.1 |
| 3,272,238 | 9/1966 | Groppe | 62/50.1 X |
| 3,345,827 | 10/1967 | Karbosky | 62/50.1 |
| 3,418,822 | 12/1968 | Massey . | |
| 3,633,372 | 1/1972 | Kimmel et al. | 62/50.1 X |
| 3,733,838 | 5/1973 | Delahunty | 62/50.1 |
| 3,962,882 | 6/1976 | Gee et al. | 62/50.1 |
| 4,219,806 | 8/1980 | Ehemark | 340/632 |
| 4,223,692 | 9/1980 | Perry | 137/78.4 |
| 4,245,814 | 1/1981 | Shimizu | 251/65 |
| 4,527,600 | 7/1985 | Fisher et al. | 141/4 |
| 4,947,651 | 8/1990 | Neeser et al. | 62/50.4 |
| 5,029,622 | 7/1991 | Mutter | 141/4 |
| 5,121,609 | 6/1992 | Cleslukowski | 62/50.4 |
| 5,127,230 | 7/1992 | Neeser et al. | 62/7 |
| 5,136,852 | 8/1992 | Neeser et al. | 62/50.4 |
| 5,163,409 | 11/1992 | Gustafson et al. | 62/50.2 X |
| 5,214,925 | 6/1993 | Hoy et al. | 62/50.6 |
| 5,228,295 | 7/1993 | Gustafson | 62/7 |
| 5,228,585 | 7/1993 | Lutgen et al. | 220/4.14 |
| 5,231,838 | 8/1993 | Cleslukowski | 62/50.4 |
| 5,315,831 | 5/1994 | Goode et al. | 62/7 |
| 5,325,894 | 7/1994 | Kooy et al. | 141/4 |

FOREIGN PATENT DOCUMENTS

| | | | |
|---|---|---|---|
| 734169 | 5/1966 | Canada | 62/48.2 |
| 14919 | 2/1977 | Japan | 62/49.1 |
| 51099 | 3/1982 | Japan | 62/50.1 |
| 103996 | 6/1982 | Japan | 62/47.1 |
| 46098 | 2/1987 | Japan | 62/49.1 |

*Primary Examiner*—Christopher Kilner
*Attorney, Agent, or Firm*—Marc A. Hubbard

[57] ABSTRACT

An automated fueling facility allows untrained persons to safely dispense homogeneous phase liquid methane from a cryogenic storage tank into a motor vehicle. The fueling facility automatically maintains pressure on the liquid methane within a predetermined safe operating range using methane gas trapped in the cryogenic storage tank. The pressure on the liquid methane is at least set equal to a set pressure equal to the sum of the saturation pressure of the liquid methane plus an additional amount to help to ensure that it remains in a fully saturated condition after exposure to any pressure losses as the fluid enters the pump. A pump is cooled by placing it in the storage tank and circulating liquid methane through the pump and back into the storage tank. A dispenser, including nozzle for connecting to a motor vehicle, is cooled by circulating liquid through the nozzle and back to the storage tank through a receptacle on the dispenser to which the nozzle is connected. No dispensing of liquid methane into a motor vehicle tank is allowed to begin without the pressure of the liquid methane being within the operating range and the pump and nozzle pre-cooled. No additional pressure is built in the storage tank than is necessary to bring the pressure of the liquid methane to the set pressure.

21 Claims, 25 Drawing Sheets

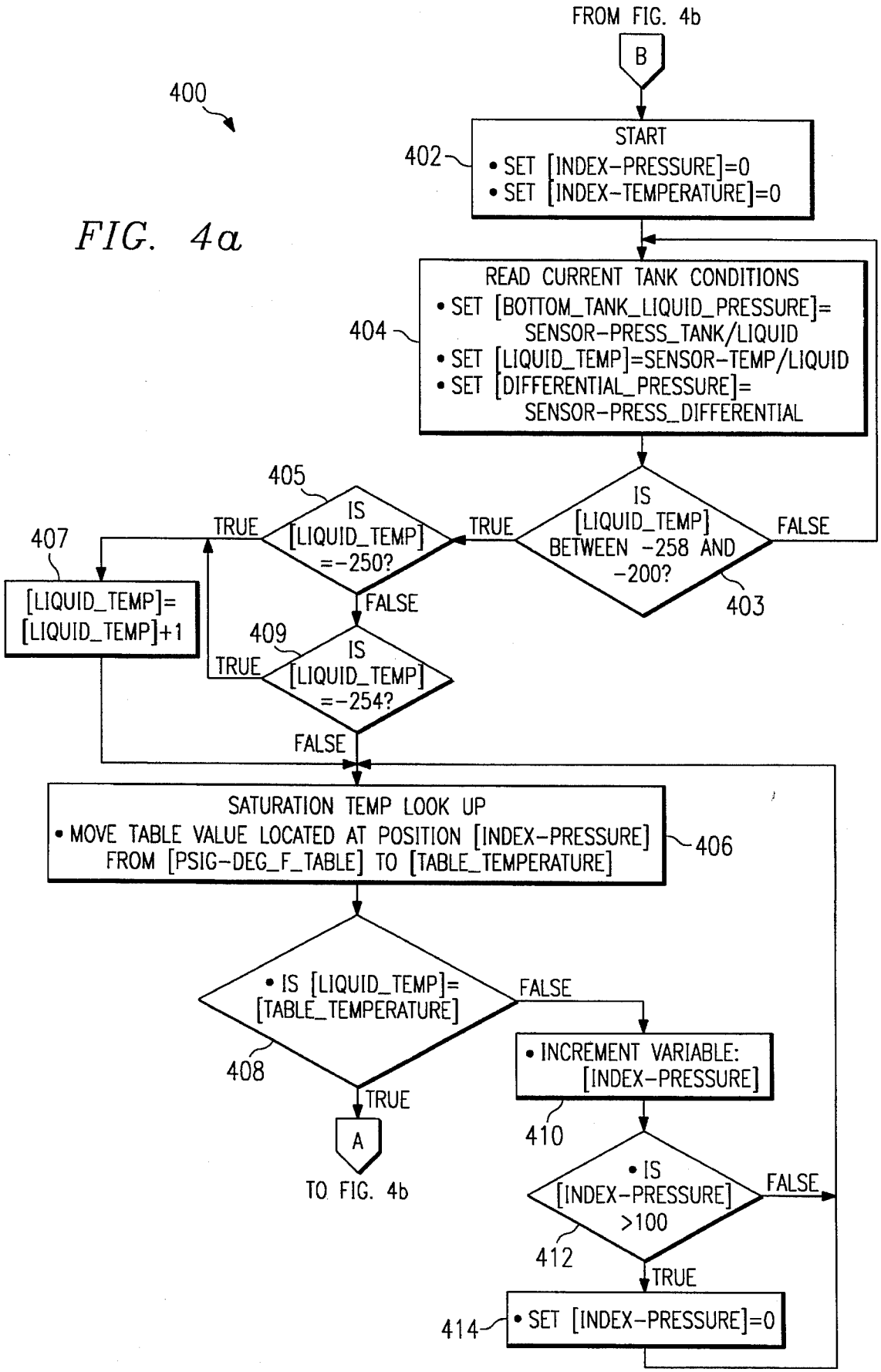
FROM FIG. 4b
B
400
402
START
• SET [INDEX-PRESSURE]=0
• SET [INDEX-TEMPERATURE]=0
FIG. 4a
READ CURRENT TANK CONDITIONS
• SET [BOTTOM_TANK_LIQUID_PRESSURE]= SENSOR-PRESS_TANK/LIQUID
• SET [LIQUID_TEMP]=SENSOR-TEMP/LIQUID
• SET [DIFFERENTIAL_PRESSURE]= SENSOR-PRESS_DIFFERENTIAL
404
405
IS [LIQUID_TEMP] =-250?
TRUE
IS [LIQUID_TEMP] BETWEEN -258 AND -200?
TRUE
FALSE
403
407
[LIQUID_TEMP]= [LIQUID_TEMP]+1
FALSE
409
IS [LIQUID_TEMP] =-254?
TRUE
FALSE
SATURATION TEMP LOOK UP
• MOVE TABLE VALUE LOCATED AT POSITION [INDEX-PRESSURE] FROM [PSIG-DEG_F_TABLE] TO [TABLE_TEMPERATURE]
406
• IS [LIQUID_TEMP]= [TABLE_TEMPERATURE]
FALSE
408
TRUE
A
TO FIG. 4b
• INCREMENT VARIABLE: [INDEX-PRESSURE]
410
• IS [INDEX-PRESSURE] >100
FALSE
412
TRUE
414
• SET [INDEX-PRESSURE]=0

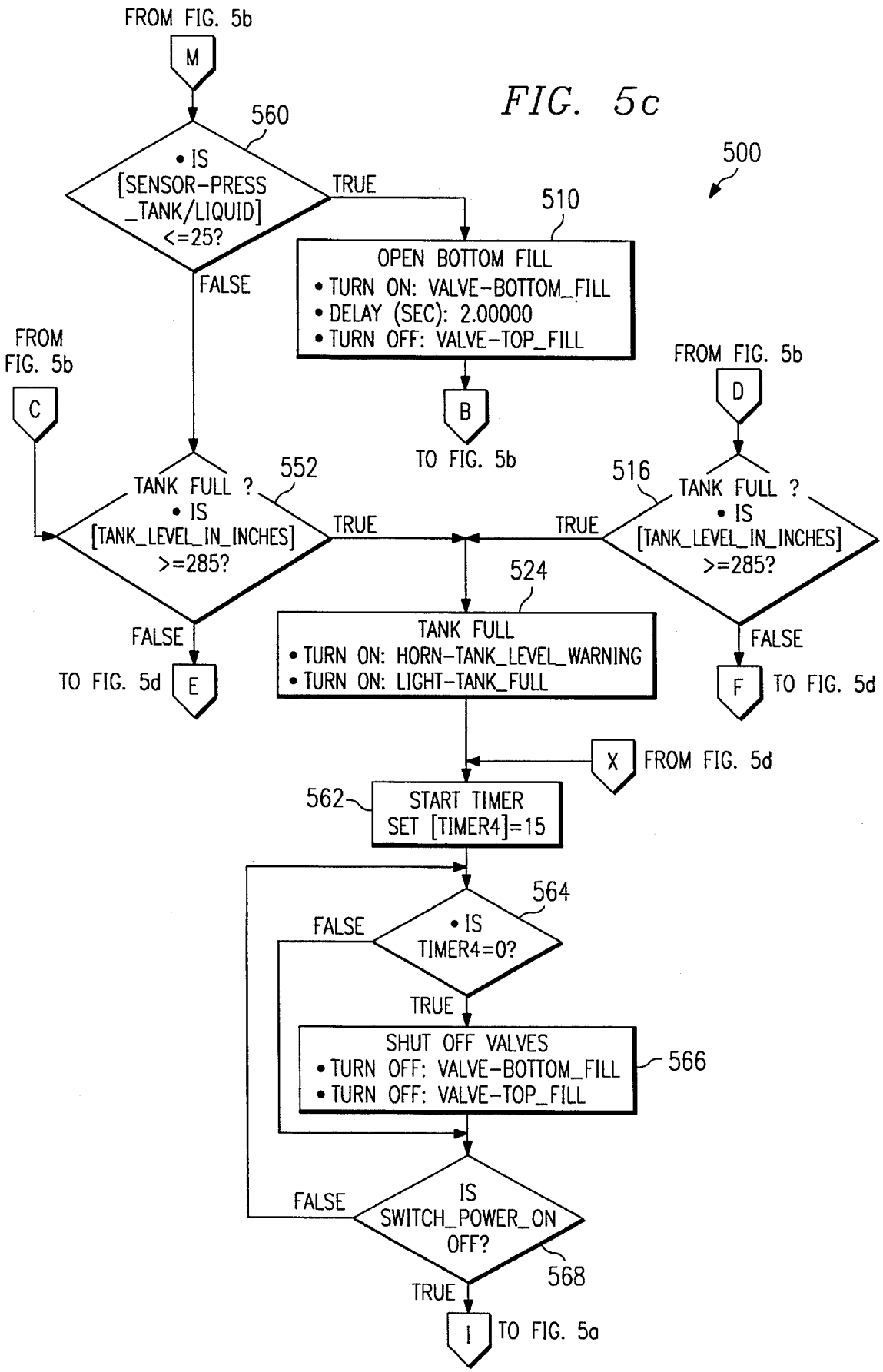
FIG. 5c
500
FROM FIG. 5b
M
560
• IS [SENSOR-PRESS_TANK/LIQUID] <=25?
TRUE
FALSE
510
OPEN BOTTOM FILL
• TURN ON: VALVE-BOTTOM_FILL
• DELAY (SEC): 2.00000
• TURN OFF: VALVE-TOP_FILL
B
TO FIG. 5b
FROM FIG. 5b
C
FROM FIG. 5b
D
552
TANK FULL ?
• IS [TANK_LEVEL_IN_INCHES] >=285?
TRUE
FALSE
TO FIG. 5d
E
516
TANK FULL ?
• IS [TANK_LEVEL_IN_INCHES] >=285?
TRUE
FALSE
F
TO FIG. 5d
524
TANK FULL
• TURN ON: HORN-TANK_LEVEL_WARNING
• TURN ON: LIGHT-TANK_FULL
X
FROM FIG. 5d
562
START TIMER
SET [TIMER4]=15
564
• IS TIMER4=0?
FALSE
TRUE
SHUT OFF VALVES
• TURN OFF: VALVE-BOTTOM_FILL
• TURN OFF: VALVE-TOP_FILL
566
IS SWITCH_POWER_ON OFF?
FALSE
TRUE
568
I
TO FIG. 5a

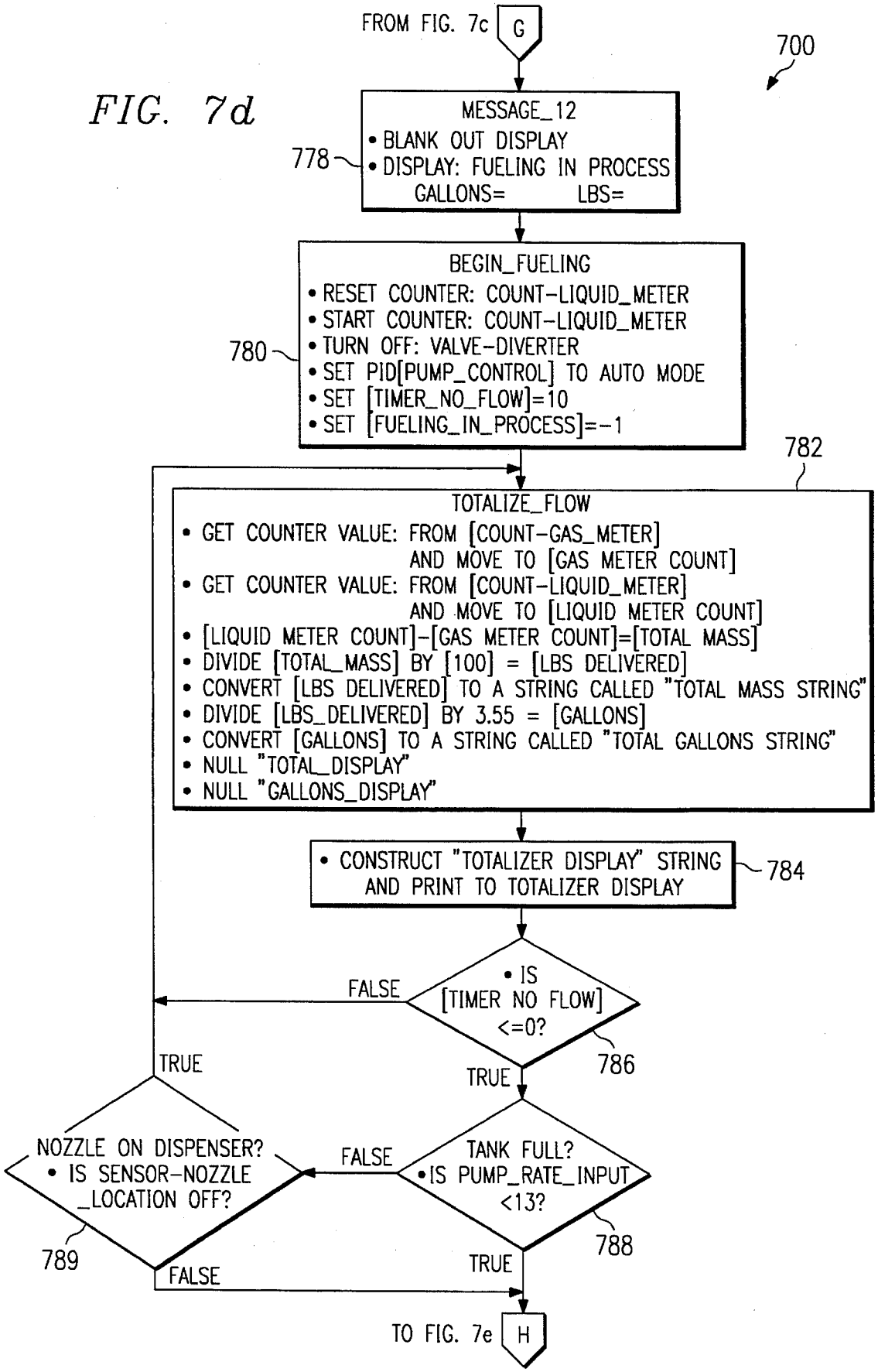
FIG. 7d
FROM FIG. 7c
G
700
MESSAGE_12
• BLANK OUT DISPLAY
• DISPLAY: FUELING IN PROCESS
GALLONS= LBS=
778
BEGIN_FUELING
• RESET COUNTER: COUNT-LIQUID_METER
• START COUNTER: COUNT-LIQUID_METER
• TURN OFF: VALVE-DIVERTER
• SET PID[PUMP_CONTROL] TO AUTO MODE
• SET [TIMER_NO_FLOW]=10
• SET [FUELING_IN_PROCESS]=-1
780
782
TOTALIZE_FLOW
• GET COUNTER VALUE: FROM [COUNT-GAS_METER]
AND MOVE TO [GAS METER COUNT]
• GET COUNTER VALUE: FROM [COUNT-LIQUID_METER]
AND MOVE TO [LIQUID METER COUNT]
• [LIQUID METER COUNT]-[GAS METER COUNT]=[TOTAL MASS]
• DIVIDE [TOTAL_MASS] BY [100] = [LBS DELIVERED]
• CONVERT [LBS DELIVERED] TO A STRING CALLED "TOTAL MASS STRING"
• DIVIDE [LBS_DELIVERED] BY 3.55 = [GALLONS]
• CONVERT [GALLONS] TO A STRING CALLED "TOTAL GALLONS STRING"
• NULL "TOTAL_DISPLAY"
• NULL "GALLONS_DISPLAY"
• CONSTRUCT "TOTALIZER DISPLAY" STRING
AND PRINT TO TOTALIZER DISPLAY
784
• IS
[TIMER NO FLOW]
<=0?
786
FALSE
TRUE
TANK FULL?
•IS PUMP_RATE_INPUT
<13?
788
FALSE
TRUE
NOZZLE ON DISPENSER?
• IS SENSOR-NOZZLE
_LOCATION OFF?
789
TRUE
FALSE
TO FIG. 7e
H

LIQUID METHANE FUELING FACILITY

REFERENCE TO RELATED APPLICATIONS

This application is a continuation-in-part of U.S. application Ser. No. 08/007,540, filed Jan. 22, 1993, by John E. Goode, now U.S. Pat. No. 5,360,139 entitled "Liquified Natural Gas Fueling System", which is incorporated herein by reference.

FIELD OF THE INVENTION

The invention pertains generally to handling of cryogenic fluids, particularly liquid methane or natural gas; and more particularly, to automated facilities having control systems for allowing untrained people to refuel motor vehicles with liquid methane.

BACKGROUND OF THE INVENTION

Interest in the use of liquid methane, commonly referred to as liquified natural gas or LNG, as a motor vehicle fuel has increased dramatically in recent years. Entire fleets of government and industry vehicles have successfully been converted to natural gas, and some privately-owned vehicles have been convened as well. Congress recently passed an energy bill which would require further increased use of alternative fuels in government and private fleets.

Several factors have influenced this increasing interest in natural gas as a motor vehicle fuel. LNG is relatively inexpensive. It also burns very cleanly, making it much easier for fleets to meet more restrictive pollution emission standards. However, handling LNG remains a significant problem.

An LNG fueling facility typically includes a massive LNG storage tank and a dispensing system. The dispensing system usually relies on a pump to deliver LNG from the massive storage tank to the vehicle. Refrigeration is very expensive. Therefore, insulation around the massive LNG storage tank is relied on exclusively in most installations to maintain methane in a liquid state. Storing and dispensing LNG from an insulated tank poses several problems.

LNG is preferably kept in a saturated state in the massive storage tank and as it is pumped through the dispensing system. Otherwise, heterogeneous phase methane is dispensed into a vehicle, which is undesirable. First, a vehicle's tank is only partially filled with usable fuel, reducing the range of the vehicle. The time between vehicle refuelings falls and this places an increased burden on the limited capacity of an LNG fueling facility to service a fleet. Second, obtaining an accurate measure of the amount of LNG actually dispensed into a vehicle's tank is not possible using conventional mass flow meters. The LNG fueling facility therefore cannot accurately charge for the LNG dispensed, which is especially important for facilities intended to service multiple fleets or individual consumers.

Pressure within the massive storage tank must also be kept below a maximum allowed pressure for safety. It is physically impossible to insulate a tank for no heat transfer. Therefore, heat from the environment continually warms the liquid methane. Once the temperature of the liquid methane rises above its saturation temperature, the pressure under which the liquid is placed, the liquid methane boils, trapping the vapor in the tank. The liquid methane continues to boil off vapor, raising the pressure in the tank until the pressure on the liquid methane reaches saturation pressure for the temperature of the liquid. Additional volume made available from dispensing of LNG relieves some pressure. However, if the pressure within the tank meets or exceeds a maximum safe pressure, it must be vented in a procedure colloquially referred to as "blowing down the tank". Blowing down a tank is undesirable. Releasing methane into the atmosphere can create a potential for explosion and is an environmental hazard. Although conditions which surround venting can be carefully controlled to minimize risks, releasing methane into the atmosphere is preferably avoided.

More importantly, taking the pressure off the liquid may lower its saturation temperature below its actual temperature, causing the liquid to boil. Blowing down the tank thus results in boiling, with the methane coming out of a homogeneous liquid phase and assuming a heterogeneous phase. Blowing down the tank, however, dispels heat from the tank and results in lowering the liquid temperature. Less pressure is thus required to maintain the methane in a saturated liquid phase after blow-down. Nevertheless, it is still desirable to slightly "sub-cool" the liquid methane by passing some liquid through a heat exchanger to vaporize it and returning the vapor back to the tank to pressurize and compress the liquid to raise its saturation temperature. Thus, some heat is returned to the gas occupying the void in the tank above the liquid level.

Specially trained operators are usually required to maintain the facility and to dispense the LNG. Having to employ specially trained operators to handle the LNG and cryogenic fluids not only makes LNG fueling stations more costly, it also makes them generally less appealing to fleet operators and particularly unappealing to average drivers who service their own automobiles. However, even specially trained operators are sometimes unable to properly condition the tank.

SUMMARY OF THE INVENTION

The invention, briefly stated, relates to a facility for dispensing cryogenic liquid. The facility conditions the tank and controls the dispensing process to order to allow untrained persons to more safely dispense cryogenic liquid. In other aspects, the system further in a homogeneous phase while minimizing venting of methane vapor from the massive storage tank. Consequently, one important advantage of the invention is that untrained persons may safely dispense homogeneous phase LNG while minimizing or possibly eliminating venting of methane gas. Thus, the invention make LNG a more viable fuel source for use by smaller fleets and by individual consumers.

A cryogenic liquid dispensing facility as described by the appended claims has several inventive aspects and advantages, a few of which are summarized below in terms of its preferred embodiment, and others of which are described in or apparent from the detailed description of the preferred embodiment illustrated in the accompanying drawings. The following summary is, therefore, for purposes of illustrating and explaining various important aspects and advantages of the preferred embodiment, and is in no way intended to limit the scope of what is claimed as the invention.

The preferred embodiment includes in addition to a massive storage tank, a pump and dispensing system, a programmable controller that receives data concerning the state of the methane in the tank and the dispensing process and then controls elements of a tank conditioning system and the dispensing system.

When dispensing is required, the controller brings LNG in the tank into condition for dispensing by bringing the pressure of the liquid at the pump's inlet to within a range of normal operating pressures. The range has a minimum pressure at which fueling is permitted to take place in order to assure that homogeneous liquid phase methane is pumped to the dispenser. To determine range of operating pressures, the temperature of the LNG near the pump inlet is read and the liquid's saturation pressure is looked up based on the temperature of the LNG. The minimum pressure is then set equal to the liquid saturation pressure at the read temperature plus an additional amount. The additional amount, referred to as compression, raises the saturation temperature of the LNG to compensate for pressure losses and heat collected in a pipeline between the storage tank and the pump and thus assures that the liquid is at a minimum net positive suction head. The new positive suction head is necessary to prevent the pump, a centrifugal pump, from cavitating by drawing on the liquid and causing the liquid to flash or vaporize. The compression thus reduces the opportunity for flashing as the LNG is pumped out of the tank. Pressure is automatically built, if necessary, up to the minimum operating pressure before dispensing is allowed. However, only enough pressure is built to compress the LNG to the set pressure, as any additional pressurization constitutes heat added to the tank. To further reduce the possibility of flashing during fueling, the pump is submerged in the LNG and, when there is no fueling taking place, LNG is circulated through the pump and back to the massive storage tank to cool the pump.

A dispensing nozzle and its associated plumbing that provides a flow of LNG to a vehicle's fuel tank is also pre-cooled immediately prior to fueling to help prevent flashing as the LNG passes through the nozzle. The dispensing nozzle and its associated plumbing is pre-cooled by placing the nozzle on the dispenser equipped with a receptacle. Fueling is not permitted until the nozzle is pre-cooled. LNG is pumped through the nozzle and back to the LNG fueling tank through the dispenser's receptacle. Once the LNG is pumped through the nozzle, the user is prompted to connect the nozzle to the vehicle and to push a fueling button when it is connected. While the nozzle is in the air, LNG continues to be pumped, but is momentarily diverted directly away from the nozzle and directly back to the storage tank. The time in which to connect the nozzle is limited to prevent the nozzle from becoming too warm. If too much time is taken, the nozzle must be re, attached to the dispenser and pre-cooling repeated. Fueling is automatically stopped when liquid is present in the vent return line at the nozzle connection to the vehicle. A specially designed, velocity fuse, incorporated in the vent return line of the nozzle, allows vapor phase fluid to pass but closes the vent line the instant liquid phase fluid is present at its inlet. Closing the vent line slows or stops the flow of fluid through fluid and vapor phase flow meters. The vapor or fluid phase flow meter senses the absence of fluid or vapor flow during the fueling operation and signals the controller that the vehicle tank is full. The instantaneous stopping of the flow through the vent line also allows the system to maintain an accurate measurement of the net weight of liquid placed in the vehicle To maintain an accurate count, the vapor phase flow meter measures the amount of methane gas released from the tank during fueling and subtracts it from the amount of LNG dispensed to keep an accurate count.

The controller automatically maintains compression on the LNG in a normal operating range, between the minimum and a maximum compression limits above the liquid saturation curve of the methane, that assures that homogeneous phase LNG is pumped from the tank and minimizes or entirely eliminates occurrences of venting vapor from the tank due to unsafe pressures in the tank. If the pressure in the storage tank exceeds the maximum compression pressure due to, for instance, return of a vapor from fuel tanks of vehicles, the controller determines whether the liquid methane is "sub-cooled" or compressed beyond that necessary to assure dispensing homogeneous phase mixture. If this extra cooling is available, liquid methane is circulated and returned into the top of the cryogenic tank to cool the methane vapor at the top of the tank, which "collapses" pressure. Recirculation to the top of the tank continues until the pressure in the tank falls to a third, intermediate set pressure that is below the high compression limit but above the low compression limit. When the pressure drops to the intermediate pressure setting, the system diverts the recirculation flow to the bottom of the tank. Stopping pressure collapsing at the intermediate pressure setting prevents pressure from falling to the minimum pressure, which triggers circulation of liquid through a heat exchanger and thus unnecessarily introduce heat into the system. Throughout filling of the tank and dispensing of LNG, the controller constantly monitors pressure and temperature sensors in the tank and updates the minimum and maximum set points, based on the current saturation pressure, as necessary during dispensing operations of the system to compensate for changes in the condition of the methane in the tank.

A pressure blow-down valve is automatically opened if the pressure unavoidably reaches the maximum pressure limit. Fueling is prevented from taking place during blow-down. After blow-down, the LNG is automatically returned to a sub-cooled condition by building pressure in the tank and compressing the LNG to a new set pressure range based on the actual temperature of the liquid.

During the filling of the cryogenic tank, the controller automatically diverts LNG from a tanker truck between a "top" fill and a "bottom" fill as necessary to avoid venting of methane vapor. The "top" fill valve is opened if the tank pressure is above the upper pressure limit and is allowed to fill through a spray bar in the top of the tank, which cools the vapor and collapses the pressure, until the pressure is lowered to the lower pressure limit. The "bottom" fill valve is then opened and filling from the bottom of the tank allows the tank pressure to rise due to the rising level of the fluid compressing the vapor trapped in the top of the tank, until the upper pressure limit is reached. This process continues until the tank is full. At the end of the fill cycle, saturated liquid delivered by the transport, which is normally delivered saturated below 15 PSI of pressure, will have been compressed to 35 PSI, thus sub-cooling the liquid. This sub-cooling will be used during the normal fuel dispensing process to collapse pressure rises in the storage tank caused by heating and vapor return from the vehicle tanks. During the filling process the tank fluid level is measured by the control system by first checking the temperature and pressure of the liquid and then determining the liquid's density from a density look-up table. The fluid depth is then determined by checking the bottom tank pressure and determining the fluid height based on the liquid's current density. This allows for accurate fluid depth measurements since the density of the fluid varies with changing fluid conditions.

BRIEF DESCRIPTION OF THE DRAWINGS

FIGS. 4*a* and 4*b* are portions of a flow chart illustrating a process for determining the condition of an LNG storage tank in the fueling station of FIG. 1 carded out by the controller.

FIGS. 5*a*, 5*b*, 5*c* and 5*d* are portions of a flow diagram illustrating the steps of a process for filling an LNG storage tank carried out by the controller.

FIGS. 7*a*, 7*b*, 7*c*, 7*d*, 7*e* and 7*f* are portions of a flow diagram illustrating the steps of the dispensing process of the fueling facility depicted in FIG. 1 and carded out by the controller.

DETAILED DESCRIPTION OF THE PREFERRED EMBODIMENT

Figure 1A:
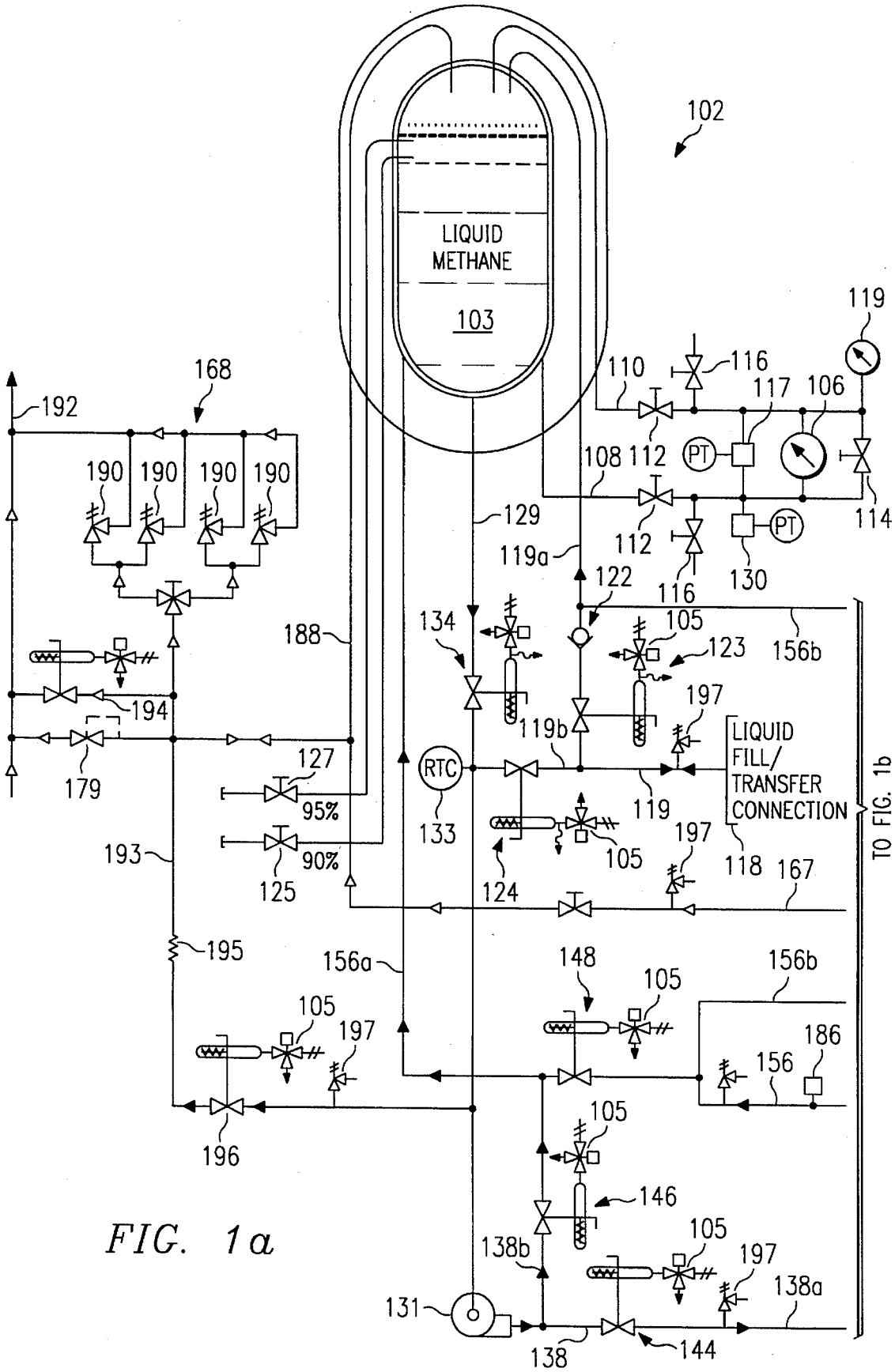
FIGS. 1*a* and 1*b* are a schematic illustration of an automated liquified natural gas (LNG) fueling station.
Figure 1B:
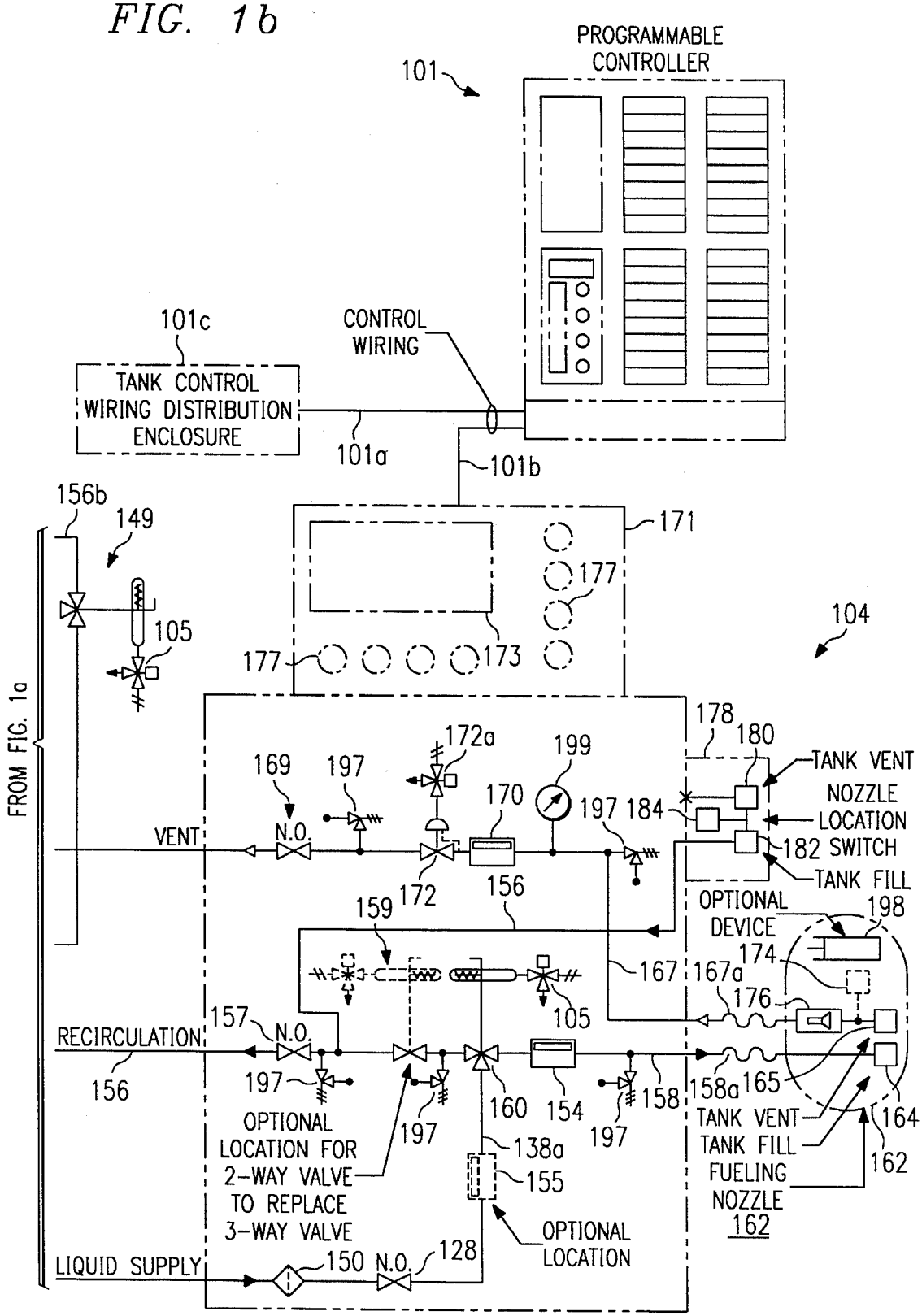

Referring now to FIG. 1, a fueling station for liquid methane, commonly referred to as liquified natural gas (LNG), includes a programmable controller 101 for automatically monitoring and controlling the condition of tank 102 and dispensing a supply of LNG 103 through dispenser 104. The programmable controller is located remotely from the tank and dispenser in a safe area such as a remotely located building. The controller includes a microprocessor and memory; digital and analog input circuits for receiving data from sensors and transducers; digital and analog output circuits for communicating data and other signals that operate valves, motors, displays; and communication ports. Alternatively, a "ladder logic" circuit, or an analog or digital computer, or dedicated hardware circuit may be adapted and used in place of a programmable controller. Signals carrying input sensor data and output data are transmitted between the controller and a distribution box via electrical lines 101A and between the controller and dispenser 104 via electrical lines 101B. Individual wires run from the distribution box to each remotely controlled valve, electric motor, and sensor associated with the tank 102. These lines have not been shown in order to simplify the drawing. Sensor and control data may also be transmitted within the system using radio frequency, infrared, or optical signals over suitable media.

Cryogenic storage tanks are well known and widely available. Tank 102 is very well insulated and is not refrigerated. It is large enough to store a volume of LNG for refueling a fleet of vehicles for weeks or months. The tank is permanently placed on site and resupplied by tanker truck. However, a tank of the type that is transported to the fueling facility holding a supply of LNG and, when the LNG is depleted, replaced with a new tank of LNG could be substituted.

The level of liquid in the tank is visually indicated by liquid level indicator 106. The level indicator is coupled through the bottom of tank 102 through line 108 and through the top of tank 102 through line 110. Manually operated valves 112 isolate the level indicator from the tank. Manually operated valve 114 equalizes the level indicator. Manually operated valves 116 are opened for bleeding the line on either side of the level indicator.

Pressure indicator 119, coupled to vapor line 110, provides a visual indication of the pressure of vapor in the tank. The level of liquid in tank 102 is remotely monitored by the controller with differential pressure transducer 117 that transmits a signal to the controller indicating the difference between the pressure at the bottom of the tank and the vapor pressure on the liquid measured near the top of the tank. The difference in pressure is due to the head of liquid methane. Knowing the specific gravity of LNG for the given temperature, the controller determines the actual height of the head. Trycock valves 125 and 127 are used to calibrate the level indicator 106 and the differential pressure sensor 117.

The supply of LNG in tank 102 is replenished through connection 118 for mating with a dispensing hose from a tanker truck. Fill line 119 branches to allow filling of the tank from the top or from the bottom, or both. Branch 119A is opened and closed with pneumatically operated top-fill valve 123, and branch 119B is opened and closed with pneumatically operated valve 124. Branch 119A terminates in a spray bar that sprays LNG into the top of the tank, cooling methane gas collecting in the top of the tank and thereby lowering the pressure of the methane gas. A check valve 122 prevents reverse flow of fluid in line 119A. Branch 119B is coupled to line 129 to fill the tank from the bottom. Filling the tank from the bottom displaces and compresses the methane vapor in the tank.

Pump 131, a centrifugal pump driven by an electric motor, draws LNG from the bottom of tank 102 through pump inlet line 129. The electric motor is run at either a fixed speed or at a variable speed dependent on a feedback signal provided by controller 101 to ensure an output having a constant flow rate under all loads or pressures. Pneumatically operated pump inlet valve 134 opens and closes line 129. The pump is preferably submerged in the LNG. Pressure sensor 130 provides a signal indicating the pressure of the liquid methane at the bottom of tank 102, relatively near pump inlet line 129. RTD temperature sensor 133 provides a signal to controller 101 indicative of the temperature of the liquid methane in the pump inlet line. Liquid is discharged from the pump's outlet through line 138.

Pump 131 discharges a flow of liquid through discharge line 138. Pump discharge line branches into liquid supply line 138A and pump recirculation line 138B. The positions of pneumatically operated pump discharge valve 144 and pneumatically operated pump recirculation valve 146 determine whether liquid discharged from pump 131 under pressure flows to dispenser 104 for prefueling and fueling operations, or whether it is recirculated back to tank 102.

Opening pump recirculation valve 146 and closing pump discharge valve 144 and pneumatically operated recirculation shut-off valve 148 forces liquid discharged by pump 131 through branch pump recirculation line 138B for recirculation to the bottom of tank 102 through bottom branch 156A of dispenser recirculation line 156. This flow of liquid cools and vents the pump and tends to stir the liquid in the tank to reduce temperature stratification of the liquid, but imparts only a minimum amount of heat to the liquid in the tank. When recirculation shut-off valve 148 is closed and pneumatically controlled pressure collapse valve 149 is opened, fluid from dispenser recirculation line 156 flows through top branch 156B of the dispenser recirculation line 156 to top branch 119*a* of fill line 119 and then into the top of tank 102. Recirculating sub-cooled liquid methane to the top of the tank collapses the pressure of methane vapor in the top of the tank and thus reduces excessive pressure without venting or taking the liquid methane out of a saturated liquid state. During liquid recirculation, the electric motor of pump 131 is operated at a relatively slow, fixed rate.

When pump recirculation valve 146 is closed and pump discharge valve 144 is open, liquid under pressure from the pump flows through liquid supply line 138A to dispenser 104. At dispenser 104, the liquid is filtered with filter 150. Inlet isolation valve 128, which is normally open, is provided for manually isolating the dispenser from supply line. The supply line 138A is coupled to recirculation line 156 and to fueling line 158 through pneumatically operated three-way diverter valve 160. In an open position, the diverter valve connects the supply line to recirculation line 156 and in a closed position to fueling line 158. Alternatively, supply line 138A is connected directly to fueling line 158, and a pneumatically controlled two-way valve, outlined with dotted lines 159, connects recirculation line 156 and fueling line 158.

The volumetric flow rate of the liquid methane flowing through fueling line 158 is measured with liquid phase methane flow meter 154. An alternate placement of the flow meter in supply line 138A is shown by dashed lines 155. The placement of the flow meter in line 158 provides for more accurate measurement of methane actually dispensed into a vehicle due to the time required to shift positions of three-way diverter valve 160 and possible leakage through valve 160 to recirculation line 156 when valve 160 is flowing to line 158 during vehicle fueling. The flow meter sends a signal indicating the flow rate to controller 101. The controller includes an analog control circuit for implementing a conventional PID or proportional integral derivative control loop. During fueling, it is desirable to provide a constant flow rate into a vehicle. Back pressure in a tank on the vehicle affects flow rate of the methane into the vehicle. The PID loop is therefore programmed to provide a feedback signal, referred to herein as the analog point output, to an input of a variable frequency motor drive attached to the electric motor driving the pump to maintain a constant flow rate through fueling line 158 by increasing or decreasing the speed of the motor to compensate for changing back pressure.

Nozzle 162 includes a connector valve 164 that prevents the flow of liquid from exiting fueling hose 158A through nozzle 162 until the connector properly mates and seals with a complementary connector on the vehicle's tank. Nozzle 162 also includes a connector valve 165 for connecting vent line 167 to a fuel tank vent of a vehicle through flexible vent hose 167A. A suitable nozzle is disclosed and described in co-pending and commonly assigned U.S. application Ser. No. 07/973,159, filed Nov. 6, 1992, which application is hereby incorporated herein by reference.

Vent line 167 returns methane vapor displaced during fueling from a vehicle's fuel tank to the top of massive storage tank 102 through line 188. Normally open valve 169 permits manual closing of the vent line. Methane gas flow meter 170 measures the mass of the gas vented through vent line 167 in order to keep an accurate measurement of the amount of methane actually dispensed into a vehicle's fuel tank. The value measured by the gas flow meter is transmitted to the controller 101.

A back pressure valve 172, placed in vent line 167 maintains back pressure on gas flowing in the vent line at the approximate pressure under which a vehicle's tank is designed to be operated. For example, a fleet of vehicles may be outfitted with cryogenic fuel tanks and systems designed to be operated under 30 PSIG. The back pressure valve 172 is then set to 30 PSIG. As the vehicle's fuel tank fills during fueling, pressure in the tank is kept at 30 PSIG. Although most fleets have fuel tanks operated at uniform pressures, the LNG fueling facility is capable of serving an individual vehicle or a fleet of vehicles with diverse fuel tank pressures. The back pressure valve is therefore variable and is set at the dispenser to match the tank pressure of the vehicle being fueled. Pilot valve 172A, when opened by controller 101, biases the diaphragm of back pressure valve 172, increasing the set point of the back pressure valve. A back pressure valve having a manually variable set point may also be used. A user operates a back pressure setting switch on user control panel 171 or enters a vehicle identification code, from which the controller determines the back pressure setting. Alternately, the back pressure valve is automatically set by controller 101 by reading on the vehicle an identification tag encoded with the tank pressure and/or a vehicle identification code which can be matched to the tank pressure stored in a database associated with the programmable controller or with the data processing system. The identification tag may be a physical configuration on the vehicle's fuel tank receptacle, a bar code, an integrated circuit, or a magnetic strip. The tag is read mechanically, optically, electrically, magnetically, or by using radio frequency signals, depending on the type of tag. The tag is preferably installed on a receptacle on a vehicle to which nozzle 162 is connected for refueling. An appropriate type of reader 198 is installed in the nozzle which communicates data indicating a vehicle's identification and tank operating pressure to the controller. The controller then sets back pressure valve 172. A visual pressure gauge 199 displays the actual back pressure in the vehicle's tank.

Instantaneously stopping the flow of LNG the instant the vehicle tank is full not only prevents waste of LNG, but also, and more importantly, prevents liquid from entering the gas flow meter 170. Liquid in the gas flow meter will render its measurements inaccurate and possibly cause damage to the gas flow meter. A flow "velocity fuse" 176 in the vent line or nozzle passes a flow of gas but immediately closes when liquid begins to flow past it. Essentially, a velocity fuse includes a poppet valve that is biased to an open position. The biasing force is greater than frictional forces on the poppet caused by a flow of venting gas past the poppet at maximum fueling rates. The biasing force is, however, less than frictional forces generated by a flow of liquid past the poppet that can be expected when the tank is full. When the poppet closes by a flow of liquid, the flow is immediately halted. The flow of venting gas past the gas flow meter 170 also falls rapidly when the poppet closes. The controller stops fueling when the flow rate indicated by the liquid flow meter 154 or, alternatively the gas flow meter 170, drops below a minimum threshold value. Fueling is stopped by shifting the diverter valve 160 or alternatively by turning off pump 131. Alternately, liquid sensor 174, indicated by dashed lines, is placed within the nozzle assembly or within vent line 167 for sensing the presence of liquid in the vent line, and for indicating that a vehicle's fuel tank is full and fueling should be shut off. However, small amounts of liquid can usually be expected in the vent line, especially when several vehicles are fueled in rapid succession. The liquid sensor thus tends to be too sensitive to left over fuel in the nozzle or vent line and thus generates spurious indications of the presence of liquid.

When not connected to the vehicle, nozzle 162 remains connected to receptacle 178 on dispenser 104. Receptacle 178 is similar to a receptacle on a vehicle. However, vent line connector valve 180 is capped. Recirculation line connector valve 182 connects to fueling line connector valve 164 and thereby couples fueling line 158 to recirculation line 156, creating an LNG recirculation loop between massive storage tank 102 and nozzle 162. Diverter valve 160 is shifted to fueling line 158 to circulate LNG through and thereby cool fueling line 158, hose 158A and nozzle 162. This pre-cooling of the dispensing system prior to fueling assures that the LNG will not flash once fueling begins and that saturated, heterogeneous liquid phase methane is dispensed into a vehicle. Sensor switch 184 communicates a signal to controller 101 indicating whether nozzle 162 is connected to receptacle 178. Liquid sensor 186 transmits a signal to the controller indicating whether there is liquid in recirculation line 156. Liquid present at the liquid sensor indicates that cool-down is complete.

User control panel 171 on top of dispenser 104 includes visual display 173 for displaying to a user total methane dispensed and messages for directing a person who is dispensing LNG. A plurality of switches 177 for starting and stopping the system, for pre-cooling and for starting and stopping fueling is provided. These buttons also provide for manual entry of data, such as vehicle identification, payment code, desired volume and/or vehicle tank pressure. The visual displays are written to by, and the buttons are inputs to, controller 101 and are connected to the controller through wiring harness 101B running between the dispenser and the controller through buried conduits (not shown).

Venting system 168 vents gas from massive storage tank 102 through line 188. The venting system includes a plurality of safety relief valves 190 that vent gas to a collection system 192 when maximum allowed pressure is exceeded in the tank. Pneumatically operated valve 194 permits the controller to deliberately vent gas from the tank. Back pressure valve 179 is set to a pressure below the maximum allowed tank pressure and above a normal operating maximum pressure. The back pressure valve bleeds off pressure above the normal operating maximum pressure to avoid pressure building to the point that safety relief valves 190 are popped.

To build pressure on LNG 103 in the massive storage tank, controller 101 opens pneumatically controlled pressure building valve 196 to allow liquid to flow to heat exchanger 195 through line 193. Heating the LNG vaporizes it. The gas is then returned to the top of massive storage tank 102 through line 188.

Each pneumatically operated valve has associated with it a three-way pilot valve 105 that is operated by an electrical signal received from controller 101. In an open position, the pilot connects a supply of instrument quality air under high pressure (120 PSIG) to a diaphragm on the valve to switch open the main valve. All pneumatically operated valves, unless otherwise noted, are biased to a normally closed position to ensure that all valves close in the event of a control system failure. In a closed position, the pilot connects the diaphragm to a vent to relieve pressure on the diaphragm, closing the main valve. A plurality of safety relief valves 197 are located throughout the system in appropriate locations to prevent excessive pressure build-up in the lines if liquid were to be trapped.

The controller 101 is programmed to perform the processes illustrated in the flow diagrams of FIGS. 2–8. A preferred programming language is a control language, called "Cyrano", for use with Mistic Controller, sold by OPTO 22, Inc. of Tumecula, Calif. However, the use of Cyrano or a programmable controller to implement the processes is not to be construed as limiting the range of alternate implementations controlling the processes. Persons skilled in the art will recognize that there are many alternatives. As previously discussed, any programmable computer, having suitable interface circuits, can be used to execute a program of instructions for carrying out the processes. The program may be written in any higher level language that can be compiled to run on the chosen computer. Furthermore, ladder logic and other type of dedicated hardware circuits may be substituted for the programmable computer.

Figure 2A:
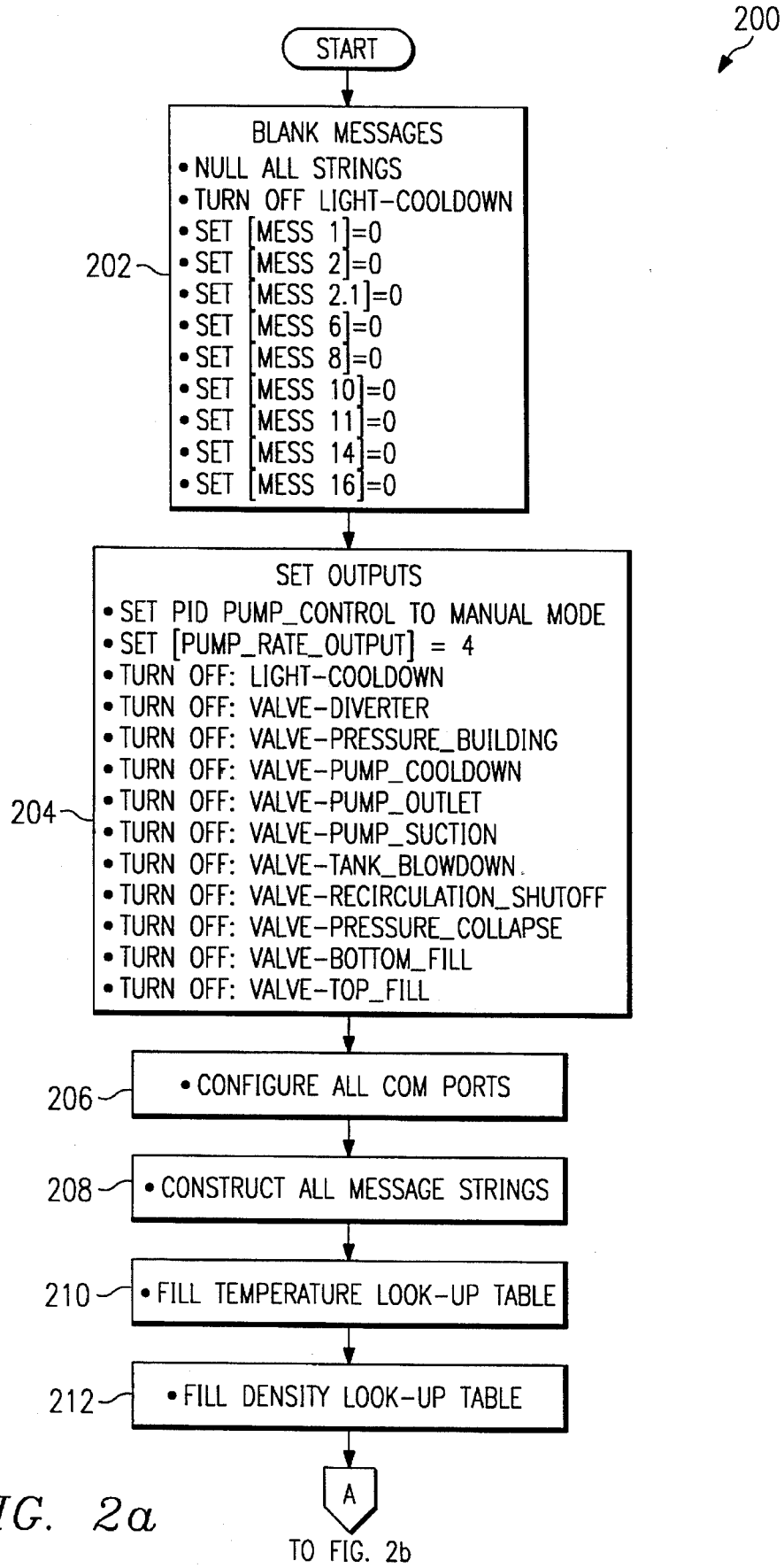
FIGS. 2*a*, 2*b* and 2*c* are portions of a flow chart illustrating the process steps of a controller upon start-up of the fueling station of FIG. 1 carded out by the controller.
Figure 2B:
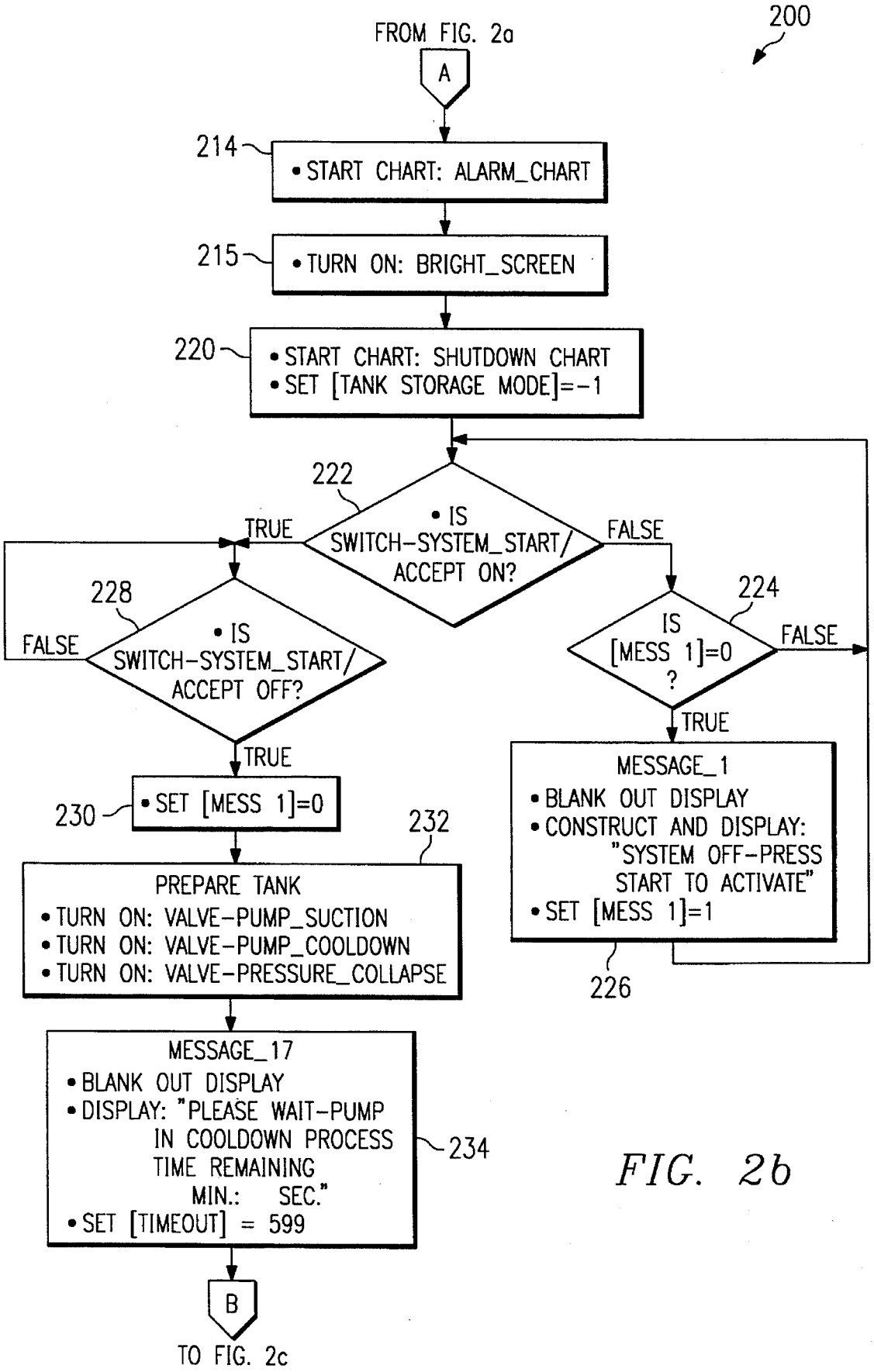
Figure 2C:
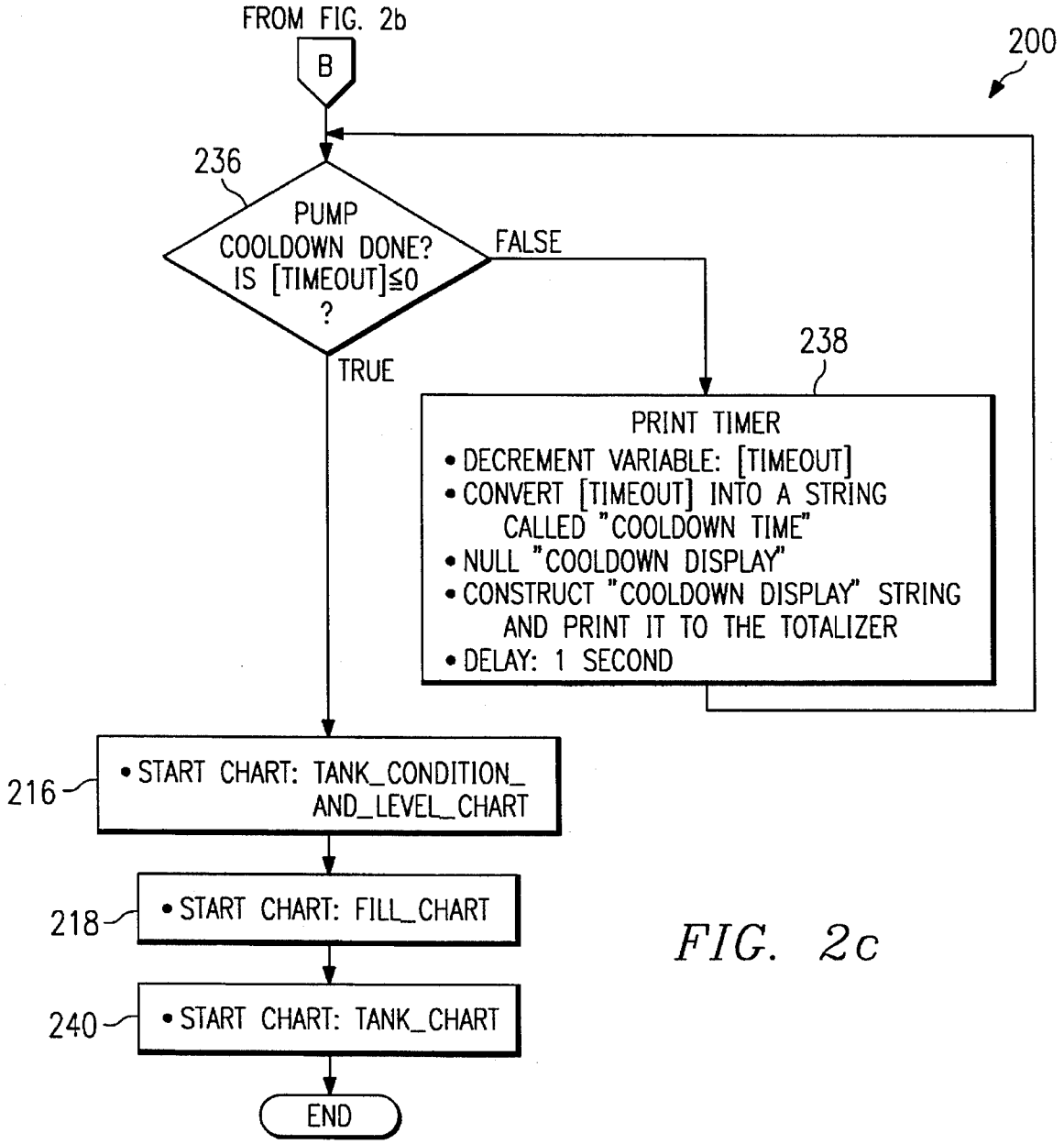

Referring now to FIGS. 1 and 2, when programmable controller 101 is reset or turned on, it automatically loads and performs the steps outlined by the flow chart shown in FIG. 2. At step 202, all messages are blanked by nulling all strings and setting equal to 0 message variables for tracking whether a particular message string has already been sent to display 173 to prevent the message from flashing on the display. All outputs on the controller are then initialized to "off" at step 204. Communication ports are set at step 206. At step 208, all message strings of character data that will be written to or printed to visual display 173 through the communication ports are created. A temperature reference table is constructed at step 210 for use by the programmer from a file containing liquid saturation pressures of methane at discrete temperature intervals. Similarly, at step 212, a density reference table is constructed from a data file containing densities of liquid methane at discrete intervals of temperature.

At steps 214 and 220, two concurrently running processes, referred to as "charts", are initiated or started. These are an alarm process at step 214 and a shut-down process at step 220, which processes are illustrated, respectively, in FIGS. 3 and 8. A bright screen mode for display 173 is turned on at step 215. Then, at step 220, the shut-down chart or process is initiated and the tank storage mode flag is set equal to true or −1.

The controller then enters a loop in which it waits for a user to push a system start switch, one of the plurality of switches 177. If the system start switch has not been depressed, as indicated by decision step 222, and if the Message 1 variable is set to 0, indicating that a Message 1 string has not yet been sent to display 173, as indicated by decision step 224, the controller blanks out display 173 and sends to display 173 the message, "System Off-Press Start to Activate", and sets the Message 1 variable equal to 1, as indicated by step 226. Once the system on switch is pressed and then, as indicated by decision step 228, released, the Message 1 variable is set equal to 0 at step 230.

A pump cool-down process then begins. At step 232, pump inlet valve 134 and pump recirculation valve 146 are opened to allow liquid to flow down line 129 to pump 131, and then from pump 131 back to tank 102 via lines 138B and 156A. As indicated by decision step 236 and step 238, pump cool-down continues for a preset time which is printed to the display 173 and counted down at one second intervals. After the pump cool-down time expires, a tank condition determination process is begun at step 216, a filling process at step 218, a tank system process is begun at step 240 and the power-up process ends.

Figure 3A:
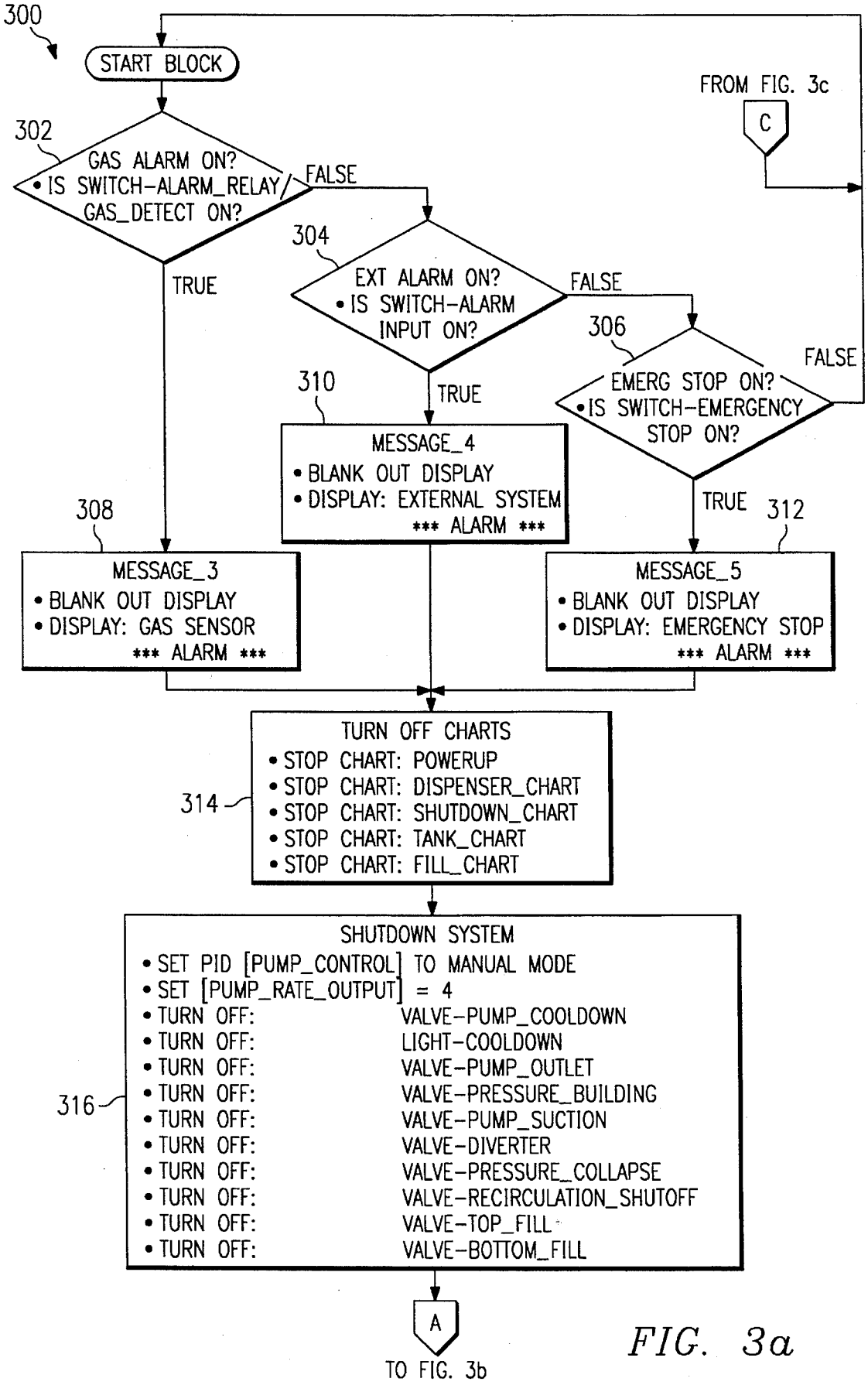
FIGS. 3*a*, 3*b*, and 3*c* are portions of a flow diagram illustrating steps of an alarm process of the fueling facility depicted in FIG. 1 carried out by the controller.
Figure 3B:
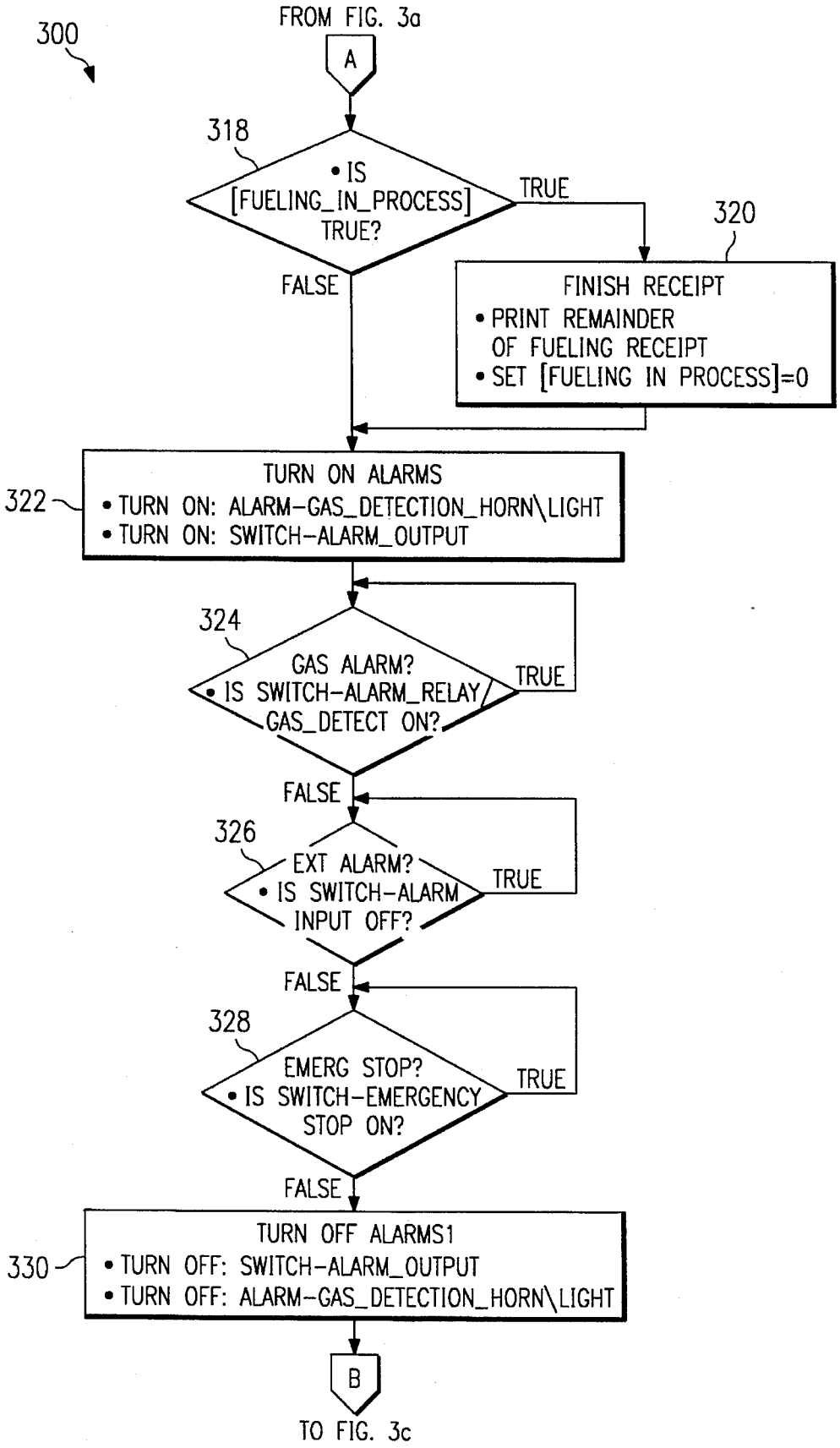
Figure 3C:
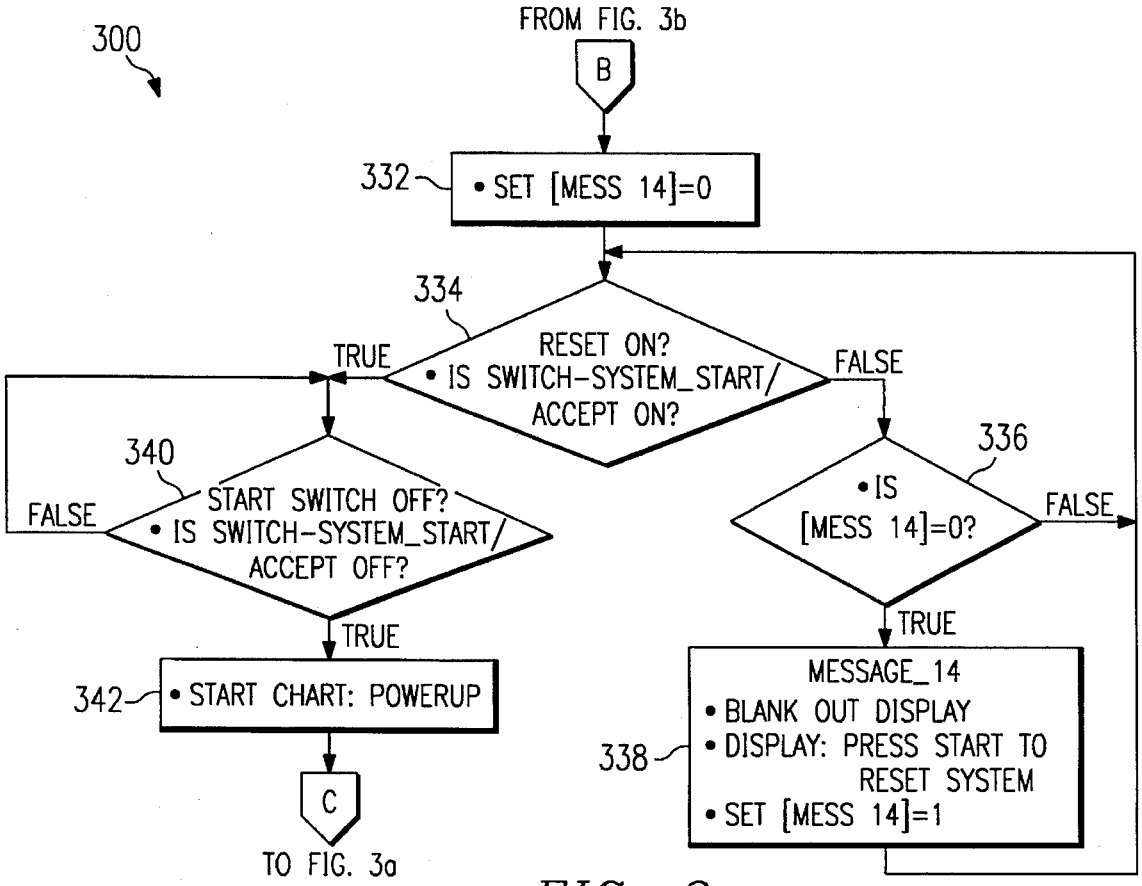

Referring to FIGS. 1 and 3, the alarm process begins with a loop formed by decision steps 302, 304, and 306 during which the controller checks for an alarm input that is activated: a relay switch input operated by a gas detector; an alarm input switch for an external alarm; and an emergency stop button on dispenser 104. If any of these alarm inputs are on, an appropriate message is displayed on display 173, as described by steps 308, 310, and 312. The controller then stops all ongoing processes at step 314, including the power-up process illustrated in FIG. 2, the tank conditioning process illustrated in FIG. 4, a filling process illustrated in FIG. 5, a shut-down process illustrated in FIG. 8, a tank system process illustrated in FIG. 6, and a dispensing process illustrated in FIG. 7. At step 316, the entire system is shut-down by turning off or automatically closing operated valves as well as disabling the PID loop control and the analog point output to the electric motor driving pump 131.

If a fueling process flag is set equal to true, meaning that fueling of the vehicle was taking place when the alarm condition arose, the remainder of a fueling receipt is printed and an end of fueling in progress flag is set equal to 0 at step 320. Otherwise, at step 322, the controller turns on a gas detection horn/light and an alarm output switch.

As indicated by decision steps 324, 326, and 328, the controller waits for all alarms to deactivate. Once all the alarm inputs turn off, the controller turns off the outputs to the alarm switch and to the gas detection horn/light at step 330. At step 332, Message 14 variable is set equal to 0. The process then enters a loop at decision step 334 to wait for the System Start/Accept switch to be turned on. If the Message 14 variable is set equal to 0 at decision step 336, Message 14 is displayed by first blanking out display 173 and writing to it, "Press Start To Reset System". The Message 14 variable is then set equal to 1 so that step 338 is not repeated. Once the System Start/Accept switch is pushed on and then released, as indicated by decision step 340, the power-up process is restarted at step 342.

Figure 4B:
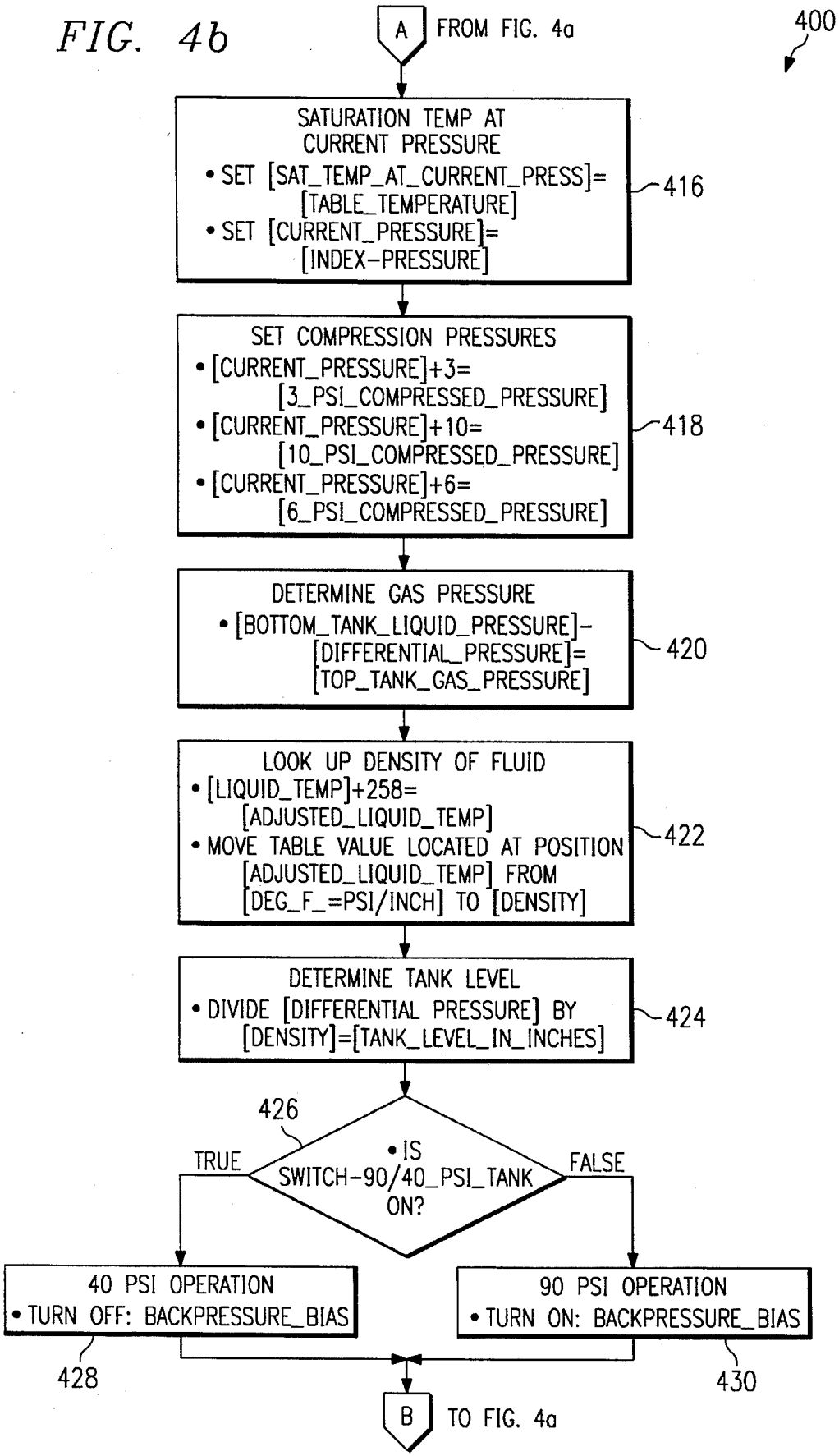

Referring now to FIGS. 1 and 4, the tank condition and level determination process 400 is started during the power-up process. The tank condition and level determination process starts at step 402 by setting indices, INDEX-PRESSURE and INDEX-TEMPERATURE, both equal to 0. The controller then, at step 404, reads the input values indicated by signals transmitted by the tank bottom pressure transducer 130 (SENSOR-PRESS_TANK/LIQUID), liquid temperature sensor 133 (SENSOR-TEMP/LIQUID), and differential pressure transducer 117 (SENSOR-PRESS_DIFFERENTIAL) and sets variables for each equal to those values.

The process then checks at step 403 whether the liquid temperature is between −258 and −200 degrees. If it is not, the process returns to step 404. If the liquid temperature is within the desired range at step 403, then the process, at step 405, determines if the liquid temperature is equal to −250 degrees. If it is, then the liquid temperature value is incremented at step 407. If it is not, the process checks at step 409 whether the liquid temperature is equal to −254 degrees. If it is, then the liquid temperature value is incremented at step 407.

The process then looks up the liquid saturation pressure corresponding to the measured liquid temperature with a table look up cycle illustrated by steps 406, 408, 410, 412, and 414. The temperature table is a table in which there is a corresponding saturation temperature entry for each discrete, 1 PSIG interval of liquid pressure from 0 to 100. The pressure values serve as an index, INDEX-PRESSURE, for each entry. The controller indexes down through the table for INDEX-PRESSURE values 0 to 100, moving the table entry storing the actual liquid temperature to a variable TABLE_TEMPERATURE, at step 406, and then comparing this variable to the variable storing the actual temperature, LIQUID-TEMP, at step 408. If there is not a match, controller increments INDEX-PRESSURE by one and repeats steps 406 and 408 until the index reaches 100, at which time it is reset to 0 as indicated by steps 412 and 414.

When the two variables match, a variable storing the liquid saturation pressure for the measured temperature, CURRENT_PRESSURE, is set equal to the INDEX-PRESSURE value at step 416. Also, a variable for saturation temperature at the value for CURRENT_PRESSURE, SAT_TEMP_@_CURRENT_PRESSURE, is set equal to the saturation temperature found on the table. At step 418, a variable storing a minimum liquid pressure, 3_PSI_COMPRESSED_PRESSURE, is set equal to CURRENT_PRESSURE plus 3 PSIG. The 3 PSIG represents the compression under which the liquid is placed to ensure that the liquid at the intake to pump 131 is under net positive pressure by compensating for any expected pressure drops between the bottom of the tank and the pump's inlet. Assuring net positive pressure at the pump inlet avoids placing the liquid under suction that would cause flashing. Similar variables, 10_PSI_COMPRESSED_PRESSURE and 6_PSI_COMPRESSED_PRESSURE, are also set up at step 418 for use in other processes.

At step 420, the pressure of the vapor on top of the liquid in tank 102 is determined by subtracting the differential pressure from the liquid pressure at the bottom of the tank as measured during step 404. At step 422, the variable ADJUSTED_LIQUID_TEMP is set equal to the liquid temperature measured at step 404 plus 258 degrees, and the density of the liquid at the adjusted liquid temperature is looked up from a density reference table. At step 424, this density is used to compute the level of liquid in the tank in inches, stored by the variable TANK_LEVEL_IN_INCHES, by dividing the differential pressure measured at step 404 by the density.

Steps 426, 428 and 430 involve setting back pressure valve 172 to one of two possible back pressures: 40 PSIG and 90 PSIG. This permits dispenser 104 to service vehicles having tanks designed to operate either at 40 or at 90 PSIG. A customer indicates which type of tank is being filled by turning one of the plurality of switches 177 to the appropriate position. If the switch is in the 40 PSIG position, the controller turns off a BACKPRESSURE_BIAS output at step 428. If the switch is in the 90 PSIG position, it turns on the BACKPRESSURE_BIAS output. Turning on the BACKPRESSURE_BIAS output opens pneumatic pilot valve 172A to apply air pressure to the back pressure valve, increasing the BACKPRESSURE_BIAS from a preset 40 PSIG to 90 PSIG. The tank condition and level determination process 400 is then repeated by returning to step 402.

Figure 5A:
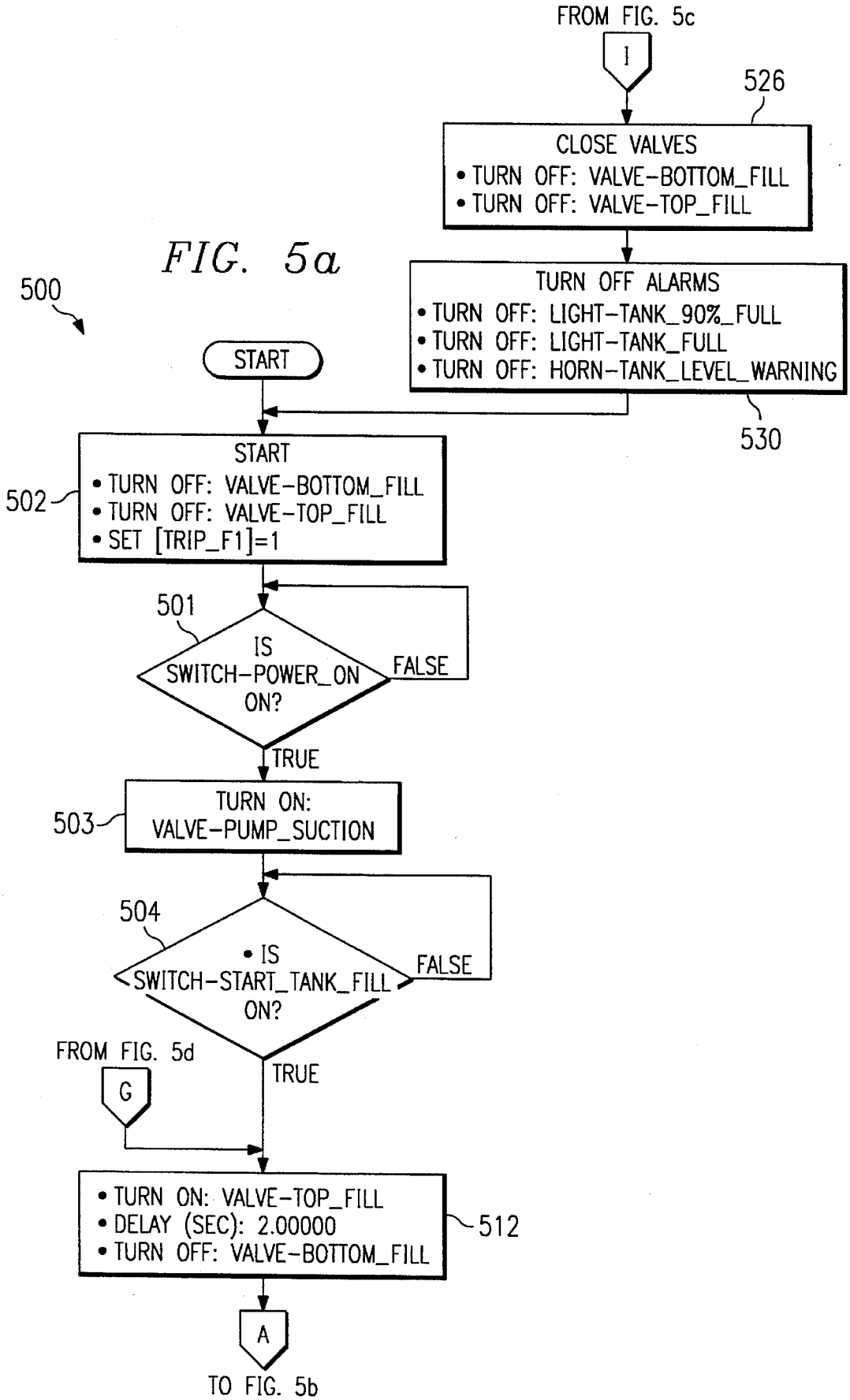
Figure 5B:
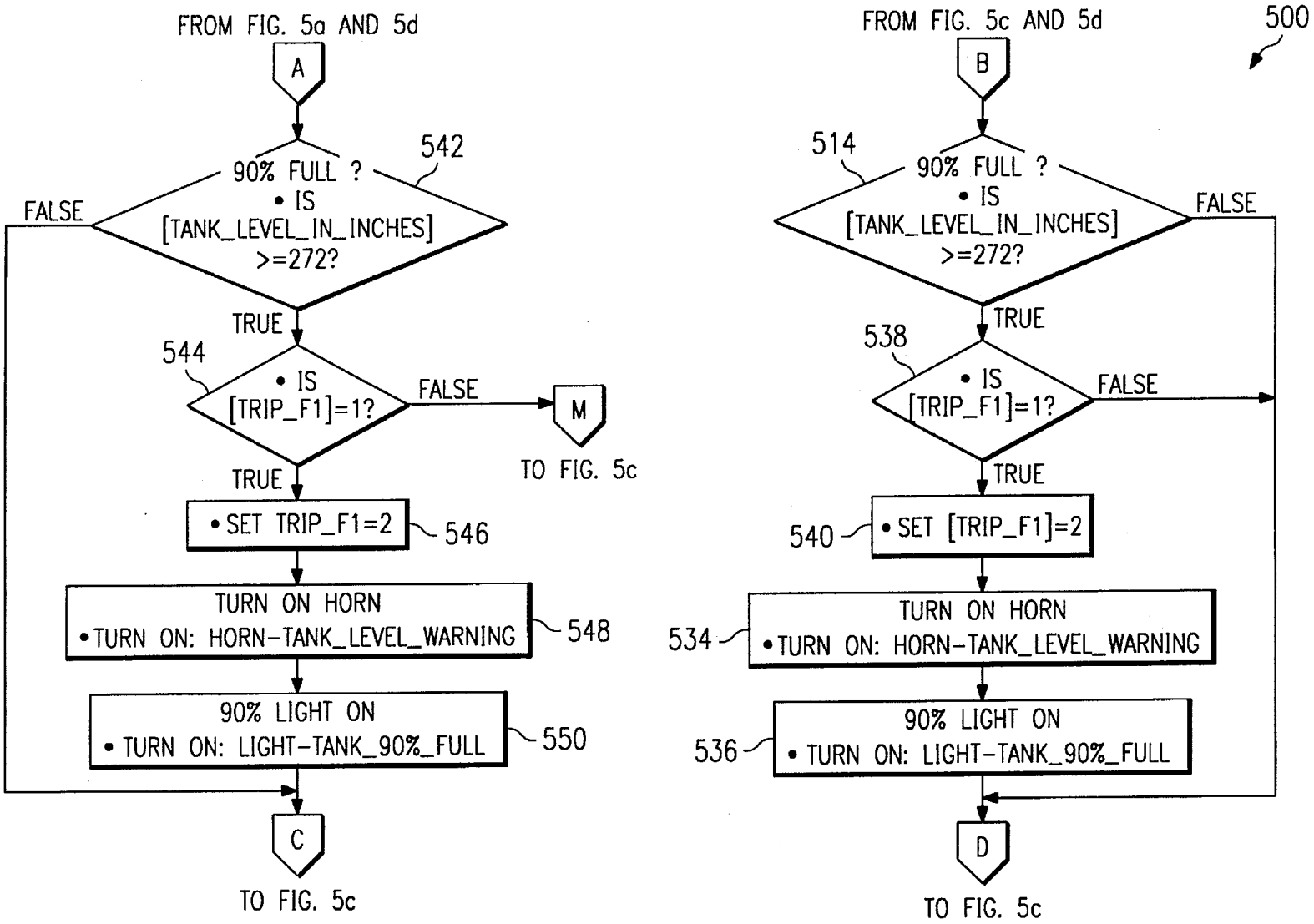
Figure 5D:
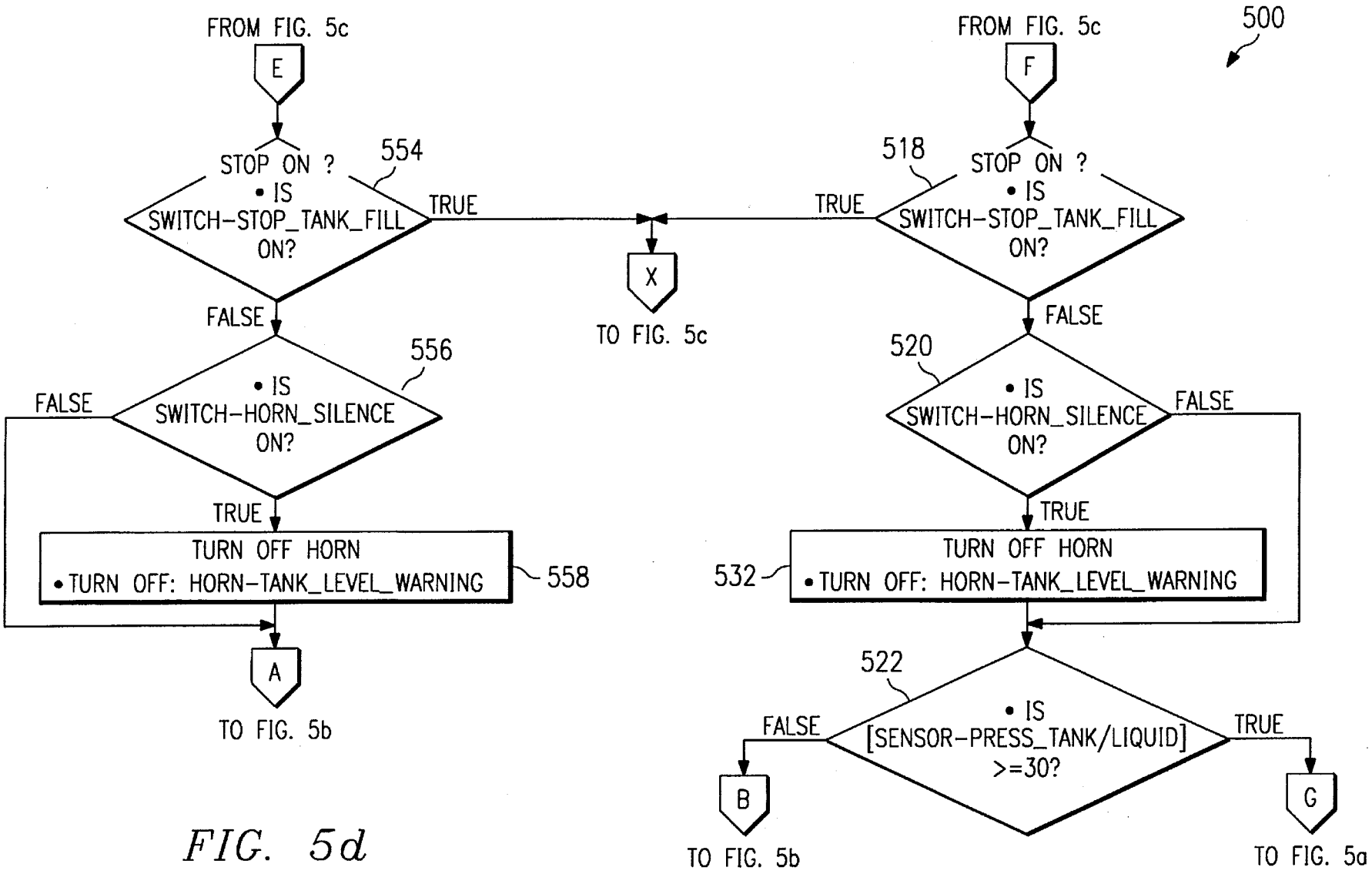
Figure 6A:
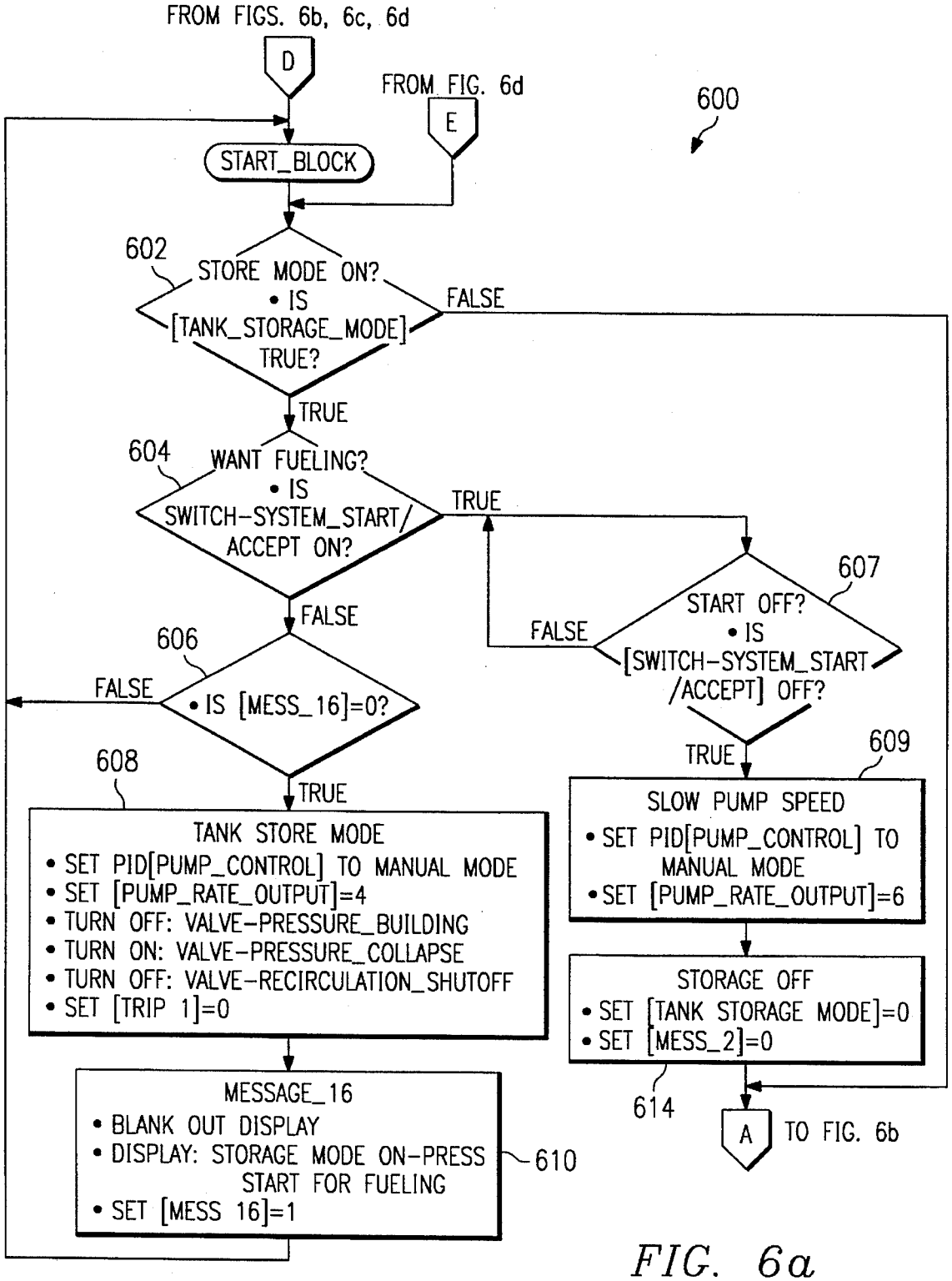
FIGS. 6*a*, 6*b*, 6*c* and 6*d* are portions of a flow diagram of a process for conditioning an LNG storage tank carried out by the controller.
Figure 6B:
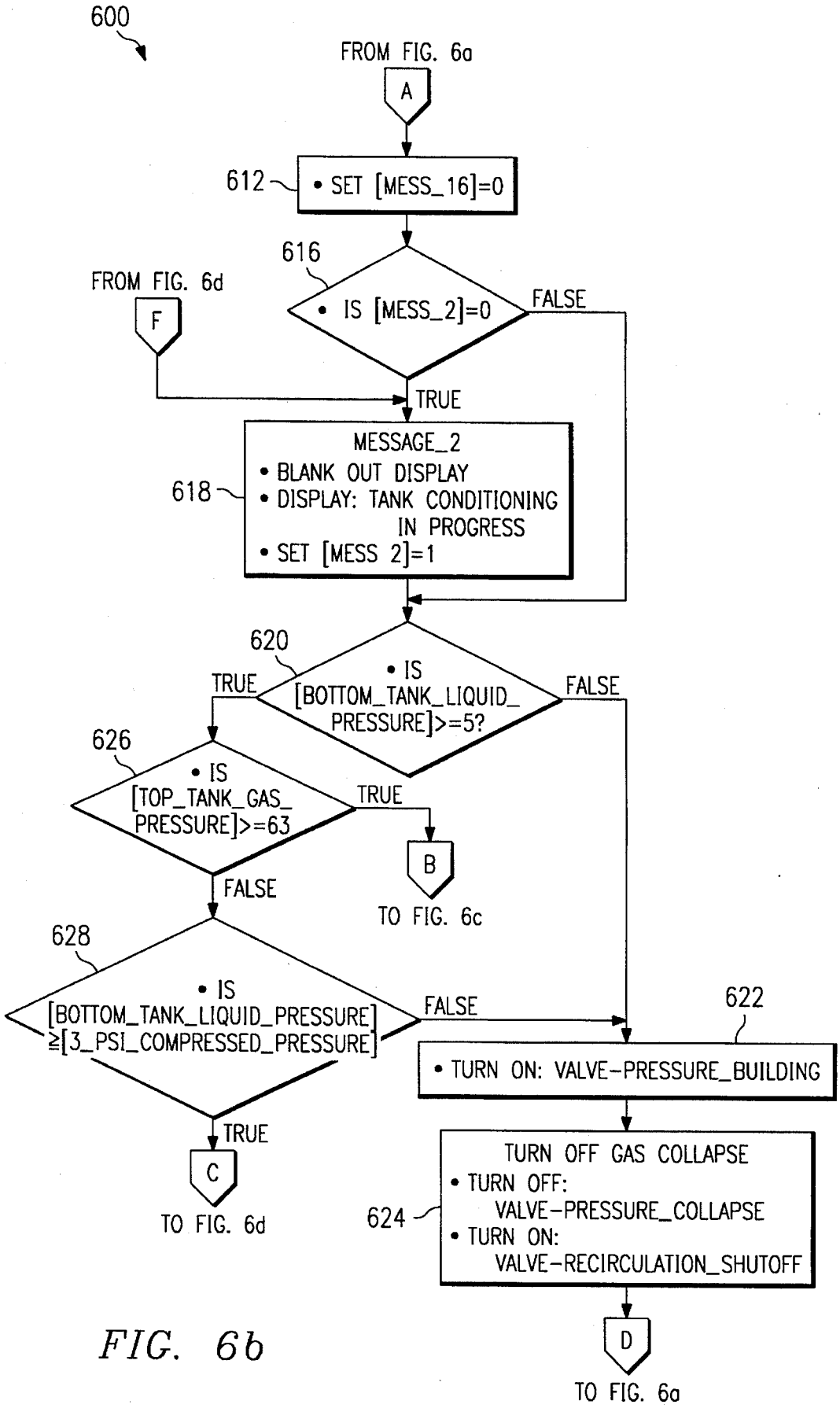
Figure 6C:
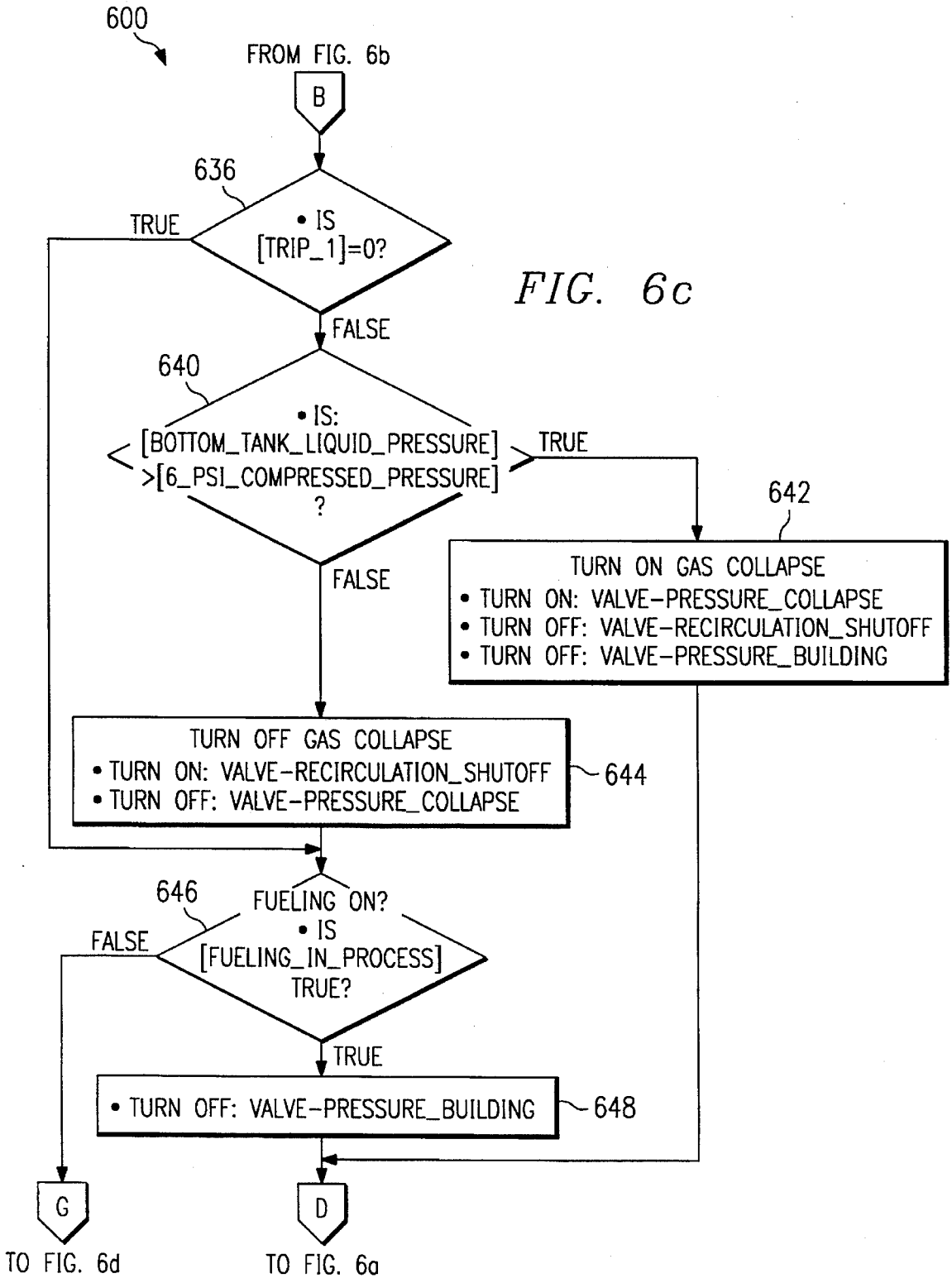
Figure 6D:
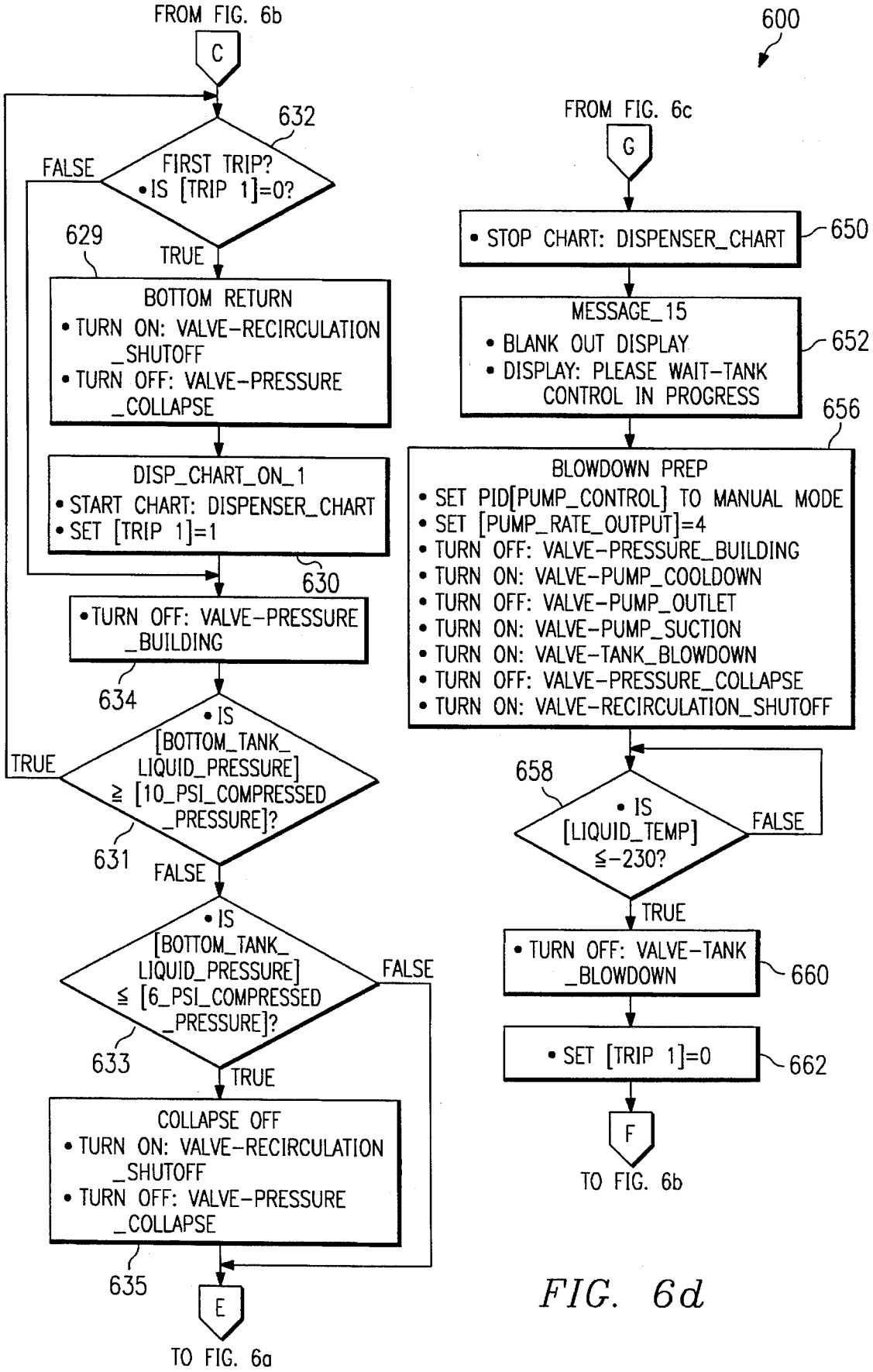
Figure 7A:
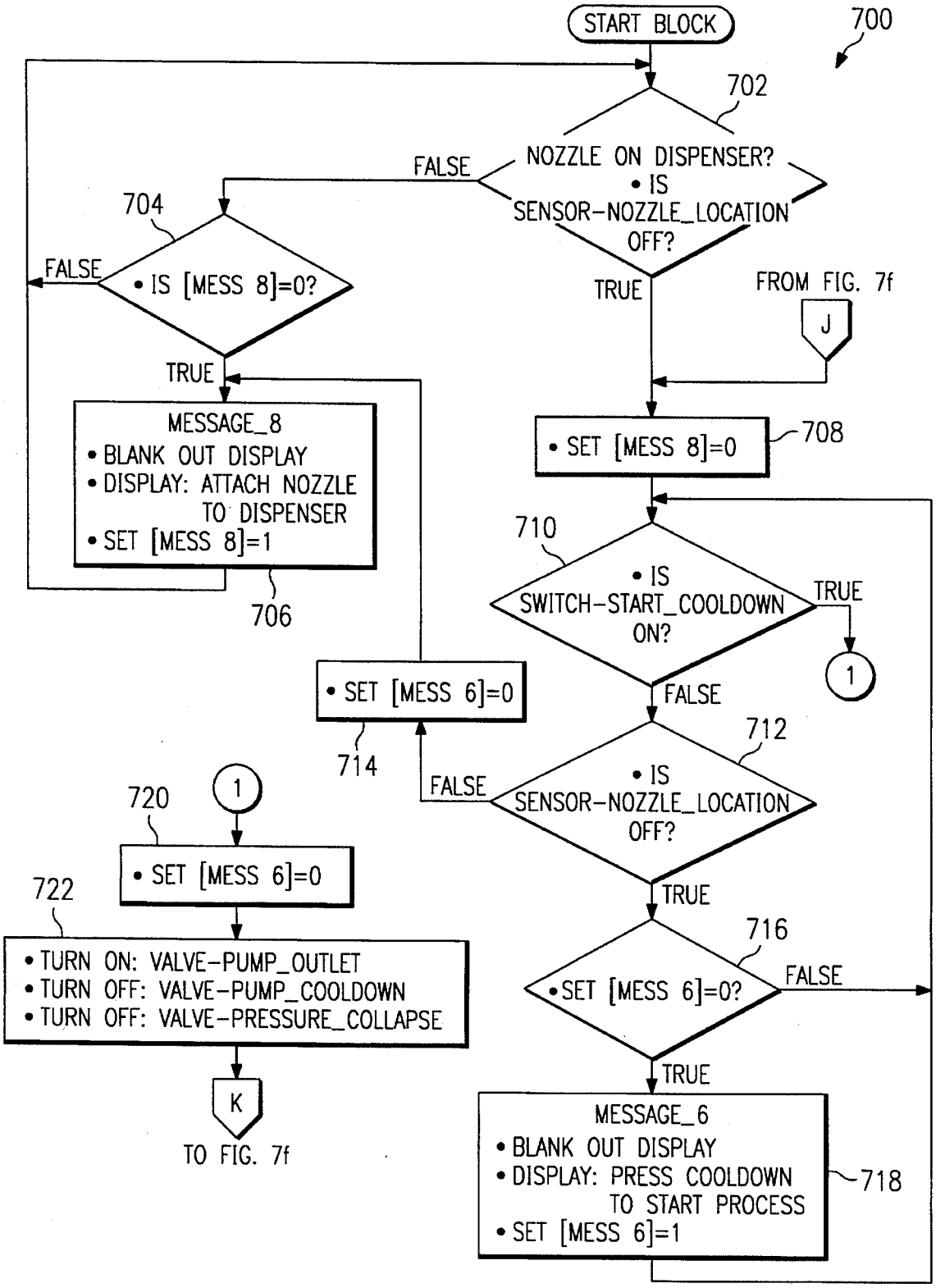
Figure 7B:
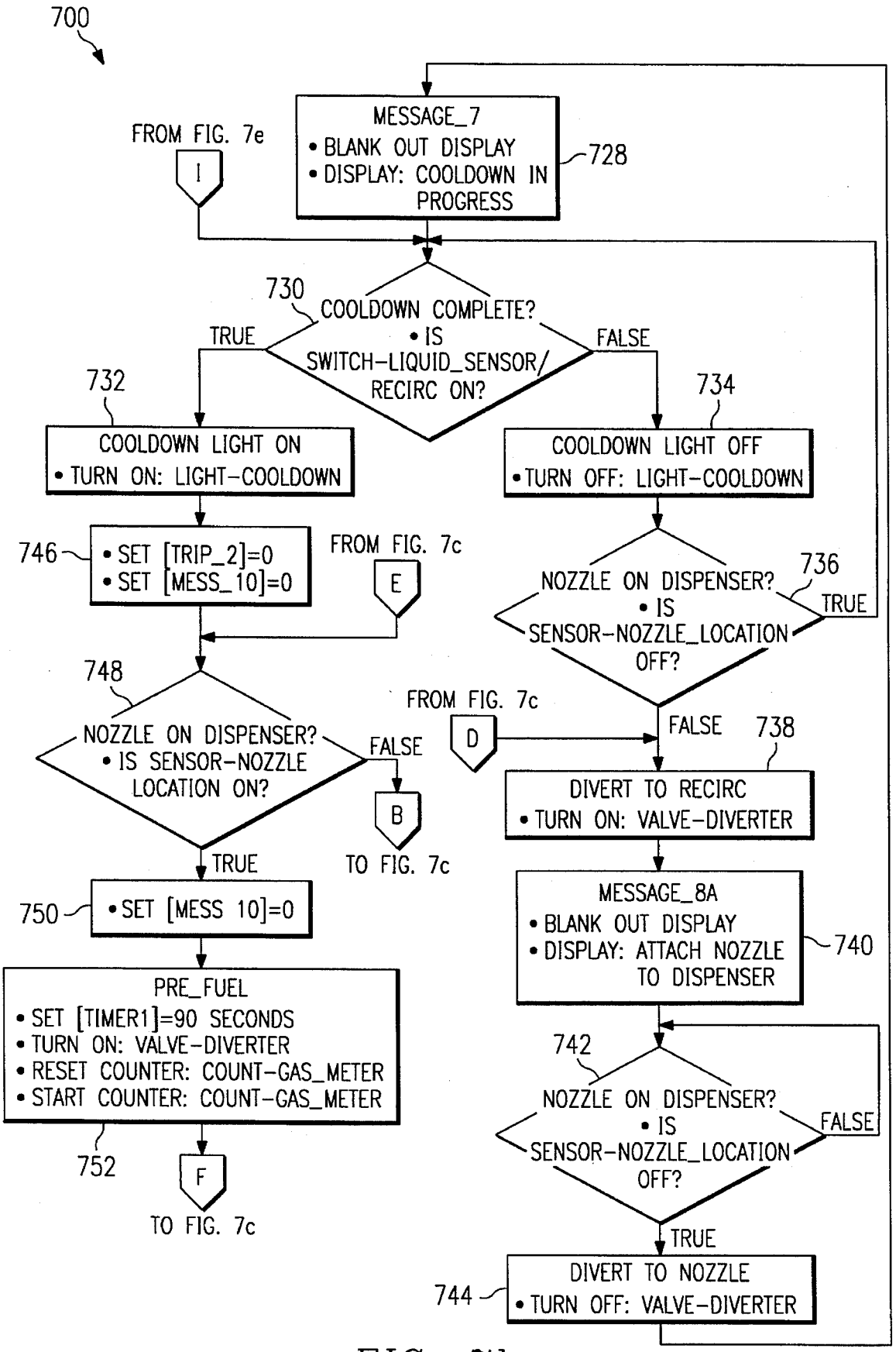
Figure 7C:
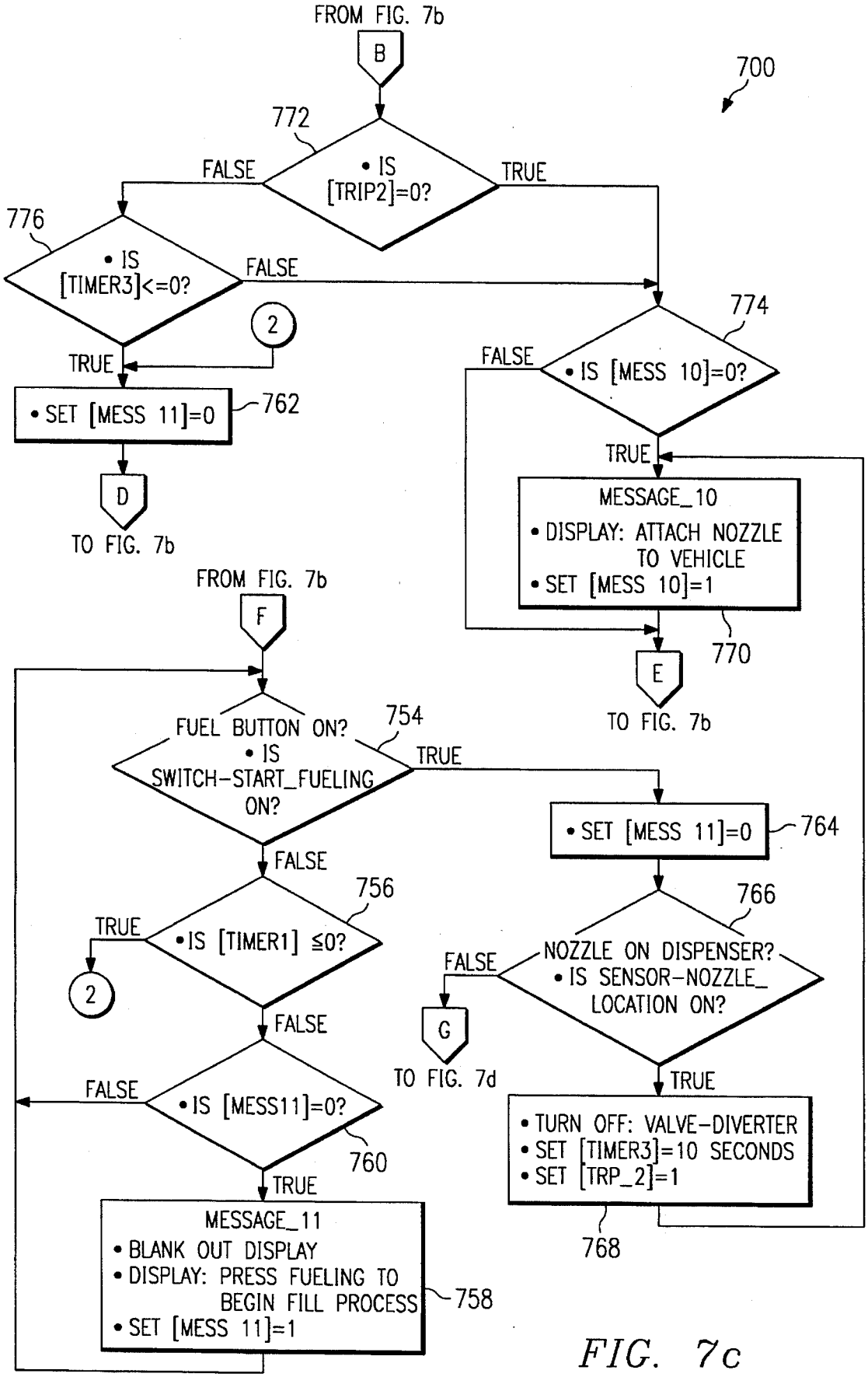
Figure 7E:
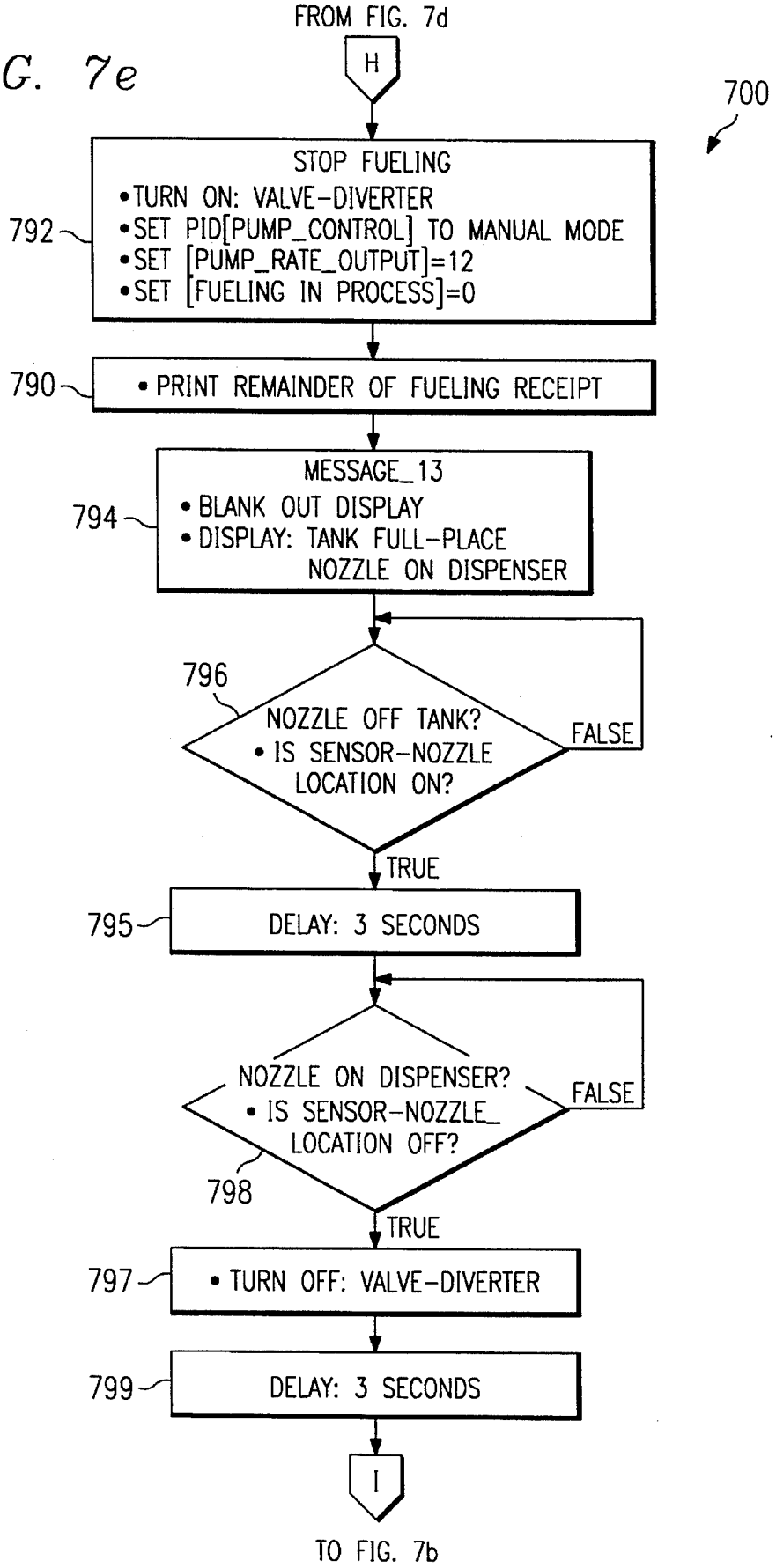
Figure 7F:
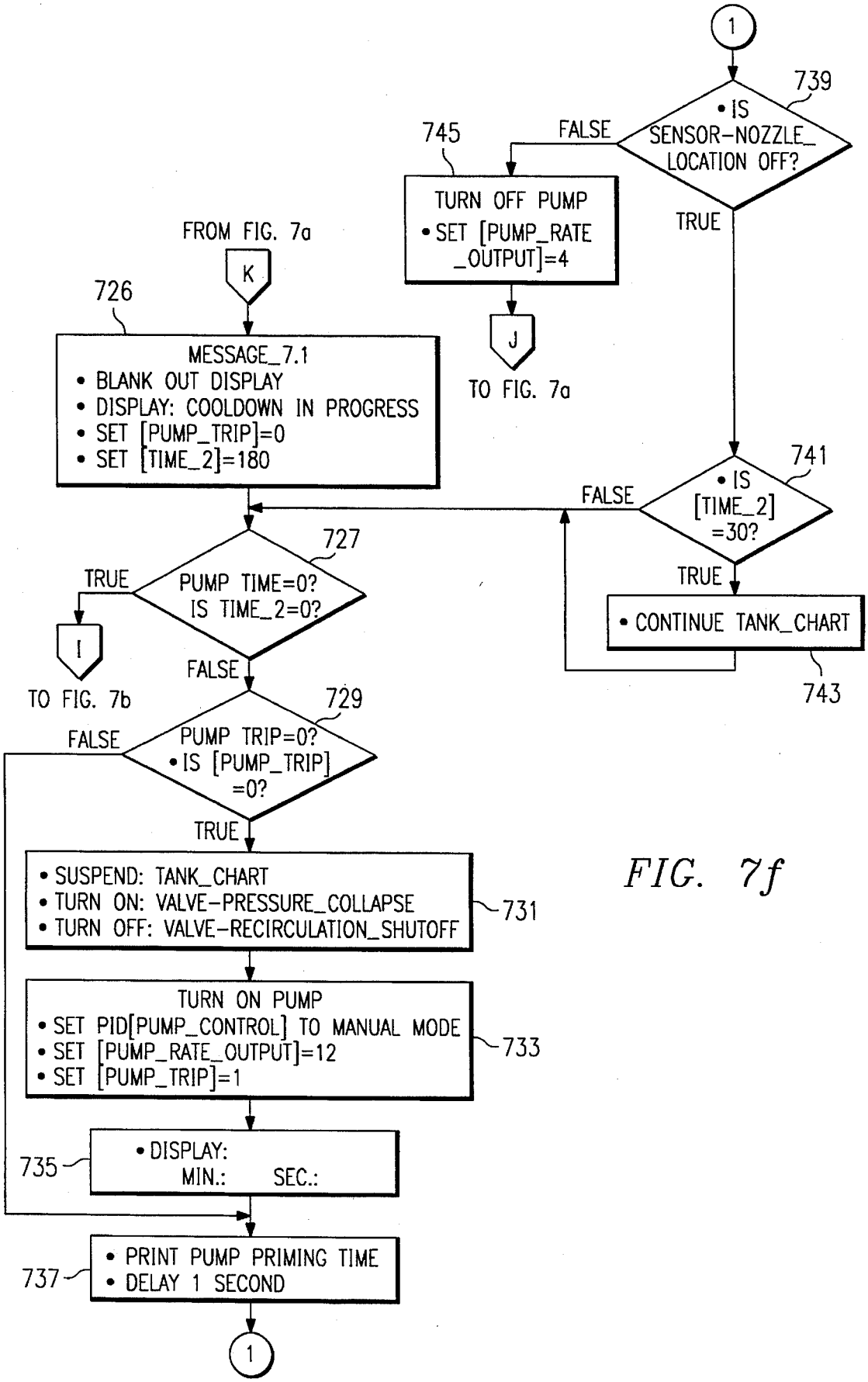

Referring now to FIGS. 1 and 5, the automated tank filling process allows the tank to be filled in a manner so as to eliminate venting of the gas by taking advantage of the low temperature fluid condition in which LNG is typically transported to the tank 102 to collapse vapor pressure in the warmer storage tank as needed. At the end of the process, the tank is in condition for dispensing of the liquid. When the process is initiated, the controller executes step 502 by turning off outputs to the bottom-fill valve 124 and top-fill valve 123 and setting variable TRIP_F1=1. The controller then waits at step 501 for the Power On switch to be activated, at which time the output for the pump inlet valve 134 is turned on at step 503 to open the valve. The controller then waits, at step 504, for an input that indicates that a Start Tank Fill switch has been turned on. Once the switch is turned on, the controller proceeds to step 5 12 in which it opens the top-fill valve 123, waits two seconds to allow it to finish opening, and then closes the bottom-fill valve 124.

This begins a top-filling process to collapse or cool vapor in the top of tank 102 with the cooler LNG supplied through connection 118 to reduce the pressure in the tank.

Looking now at the bottom-fill process, if, at step 560, SENSOR_PRESS_TANK/LIQUID is less than or equal to 25 PSIG, the controller executes step 510 by turning on an output, VALVE-BOTTOM_FILL, to open the bottom-fill valve 124. After a delay of two seconds, the controller turns off the VALVE-TOP_FILL output to close the top-fill valve 123. This delay ensures that the bottom-fill valve has time to fully open before closing the top-fill valve. LNG pumped through connection 118 then begins filling the tank from the bottom. Then, if the tank is less than 90 percent full, the process branches at decision step 514 and loops back to decision step 514. The bottom-fill process continues if: the tank is not full at decision step 516, as determined in process 400; the stop tank fill switch input is not on at step 518; and the bottom tank pressure variable, set during process 400, is less than 30 PSIG at step 522. Otherwise, a full tank at step 516 causes the controller to execute step 524 by turning on outputs causing a warning horn to sound and a light to illuminate indicating that the tank is full. At steps 562–568, the controller waits 15 seconds for the Power On switch to be turned off. If the switch is not turned off within 15 seconds, the bottom-fill valve 124 and top-fill valve 123 are closed at step 566. Once the Power On switch is turned off, bottom-fill valve 124 and top-fill valve 123 are closed at step 526 (they will already be closed if it took more than 15 seconds to deactivate the Power On switch). If the stop tank filling switch is on at step 518, the controller executes step 562, 564, 566, 568 and 526. After executing step 526, the controller turns off all alarms related to tank filling at step 530: a tank 90 percent full light; the tank full light; and the tank full warning horn. The controller then returns to starting step 502.

Once the tank reaches the 90 percent full level during the bottom-fill process at step 514, the controller turns on the output to sound the level warning horn and the output to cause the 90 percent full light to illuminate at steps 534 and 536. However, steps 534 and 536 are executed only the first time trip through the top or bottom fill process, as indicated by decision step 538 determining if the TRIP_F1 variable set equal to 1. The TRIP_F1 flag is then set equal to 2 at step 540. This allows silencing of the horn at steps 520 and 532 as the filling proceeds past the 90 percent level.

If, at step 522, the pressure in the tank equals or exceeds 30 PSIG, the controller exits the bottom-fill process and enters the top-fill process at step 512. Steps 542, 544, 546, 548 and 550 are identical to steps 514,538,540, 534 and 536, respectively. Essentially, these steps turn on the 90 percent warning light and horn allowing the warning horn, once activated, to be silenced at steps 556 and 558 during the current top-filling process. The top-filling process continues so long as the tank is not full at step 552 and the stop tank filling switch input is not on at step 554. If the tank is full, the controller executes steps 524, 562, 564, 566, 568, 526, 528 and 530, as previously described, to end the filling process. If the stop tank filling switch is on, the controller executes steps 562, 564, 566, 568, 526, 528 and 530.

Like steps 520 and 532, steps 556 and 558 silence the horn output if the silence horn switch is on.

If the bottom tank pressure ever fails below 25 PSIG during the top-filling process, the controller exits the top-filling process and enters the bottom-filling process at step 560.

In sum, the controller avoids venting of vapor during the filling process by maintaining the pressure on the liquid below 30 PSIG, and finishes the filling process with a sub-cooled liquid. The lower limit of 25 PSIG reflects a desired liquid compression of 10 PSIG above the expected 15 PSIG saturated liquid pumped in from a tanker truck. The upper limit is set as low as possible while maintaining a range between the lower and upper limits. If there is a substantial amount of vapor in the tank prior to filling, it is still possible in most cases to cool the vapor sufficiently during filling to avoid venting. The range between the upper and lower limits reduces the frequency of cycling between the bottom-filling and top-filling that causes additional wear and stress on the valves.

Figure 8:
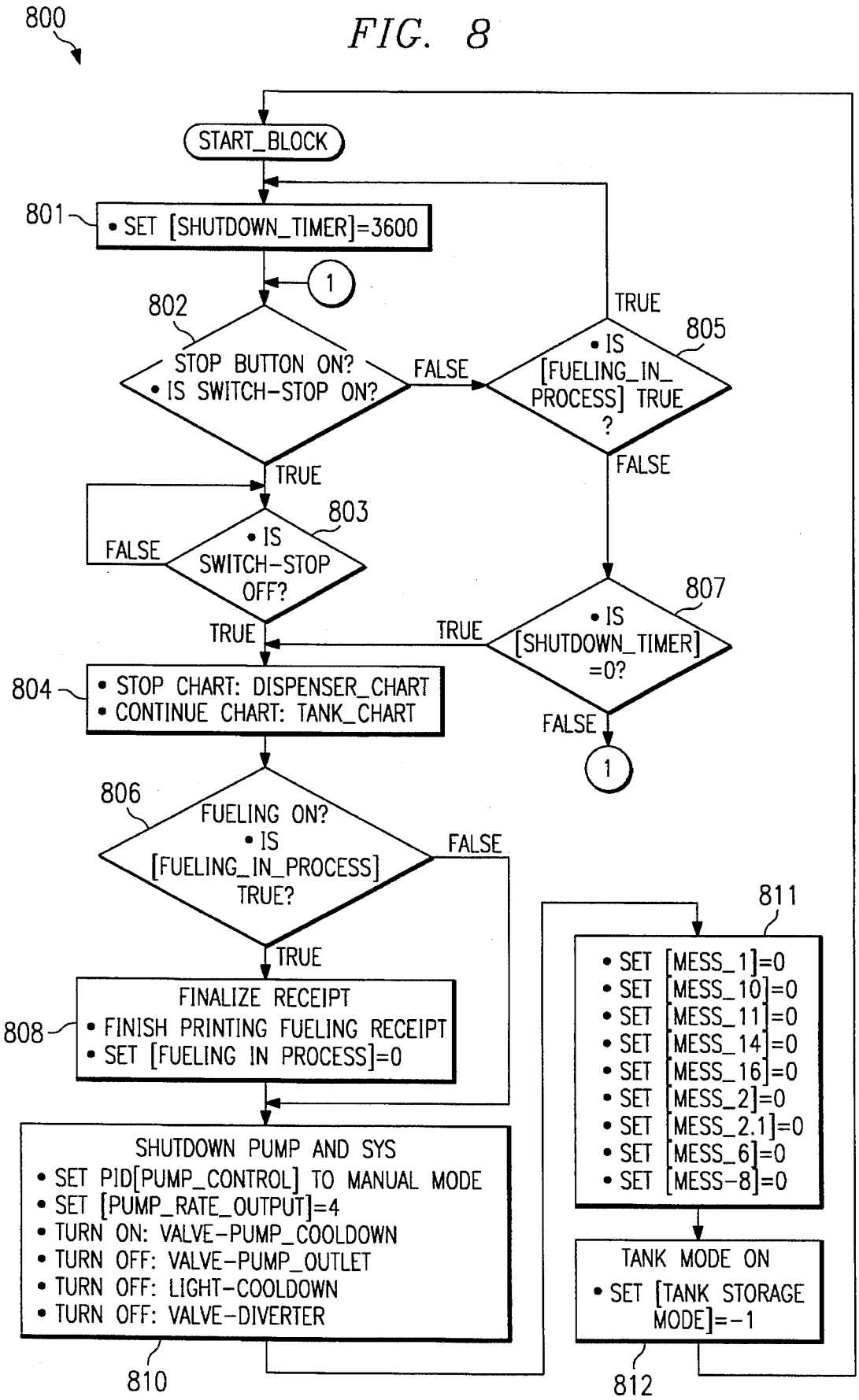
FIG. 8 is a flow diagram of a shut-down process of the fueling facility of FIG. 1 carded out by the controller.

Referring now to FIGS. 1 and 6, the flow chart illustrates process steps taken by the controller to place the tank either in a storage mode or in a conditioning mode for dispensing. As indicated by decision steps 602 and 604, the controller determines whether to place the tank in the storage mode or to proceed with a conditioning process based on whether a tank storage mode flag is set equal to true and whether the System Start/Accept switch, one of the plurality of switches 177, is on. The tank storage mode flag is set to true during start-up and shut-down, as shown in FIGS. 2 and 8 respectively. Otherwise, at decision step 606, the controller places the tank in storage mode at step 608 if a Message 16 variable is set to false. The controller sets the Message 16 variable equal to 1 after the tank is placed in the storage mode for the first time, as indicated by step 610. If the tank is already in the storage mode, the process returns to the start block and continues in this loop, waiting waits for the Start/Accept switch to be pressed at 604 and then released at step 607 before it enters a conditioning mode or process at step 609 by starting and running the pump at a slow speed without feedback control.

Placing the tank in the storage mode involves, as outlined in step 608, placing the PID loop controller in a manual control mode and setting the pump rate output of the controller to 4, which turns off the pump. It also involves turning off outputs to the pressure building valve 196, the pressure collapse valve 149, and the recirculation shut off valve 148 to close these valves. Also a trip counter variable, TRIP_1, is set equal to 0. The Message 16 is displayed at step 610 by first blanking out the display and then writing to display 173 Message 16, "Storage Mode On-Press Start for Fueling". The Message 16 variable is then set equal to 1.

If the storage mode flag is set to 0 or false at step 602, a process to place the tank in condition for dispensing begins. The Message 2 variable is set equal to 0 at step 612. The tank is placed in condition for dispensing if the Start/Accept switch is pushed while the storage mode flag is true by setting the storage mode flag to 0 and setting Message variable 2 to 0 at step 614. At step 618, Message 2 is displayed by blanking out the display and then writing "Tank Conditioning In Process" on display 173. The Message 2 variable is then set equal to 1.

At step 620, if the bottom tank pressure input is less than 5 PSIG, the controller executes steps 622 and 624 by turning on the output to pressure building valve 196 to open the valve, and turning off the output to the pressure collapse valve 149 to close the valve and turning on the output to recirculation shut-off valve 148 to open the valve. Liquid then flows into heat exchanger 195, is warmed and turned into vapor, and then returned into the top of the tank 102 to build vapor pressure within the tank. The process returns to the start block and the process continues at step 602.

If the bottom tank pressure is greater than 5 PSIG but less than 63 PSIG at step 626, the controller then determines at step 628 whether to build pressure, or continue building pressure, if pressure building has already started, based on whether the bottom tank liquid pressure input is greater than the desired bottom tank liquid pressure, 3_PSI_COMPRESSED_PRESSURE, determined at step 418 in FIG. 4. If the desired bottom tank pressure is not yet achieved, pressure building continues and steps 622 and 624 are repeated. The process returns to start and continues at step 602. If the desired bottom tank liquid pressure has been achieved at step 628, then the controller loads and concurrently runs at step 630 a dispense process, illustrated in FIG. 7. The controller bypasses steps 629 and 630, as indicated by decision step 632, and does not restart the dispense process if the trip counter variable TRIP_i is set equal to 1, indicating the dispense process has already begun and is currently running. The output to the pressure building valve 196 is then turned off to close the valve should it be open. If the bottom tank liquid pressure is greater than or equal to 10 PSI_COMPRESSED_PRESSURE at step 631, the process proceeds to step 642 to turn on the pressure collapse valve 149, to turn off the recirculation shutoff valve 148, and to turn off the output to the pressure building valve 196 to close the valve should it be open. Otherwise, if the bottom tank liquid pressure is less than or equal to 6_PSI_COMPRESSED_PRESSURE, pressure collapse valve 149 is turned off and recirculation shutoff valve 148 is turned on. On the other hand, if the bottom tank liquid pressure was greater than 6_PSI_COMPRESSED_PRESSURE at step 633, or after step 635 has been completed, the process returns to decision block 602 and continues.

If the gas pressure at the top of the tank exceeds 63 PSIG at decision step 626, the controller first determines from the status of the trip counter variable flag TRIP_1 at step 636 whether the dispense process has been started. If the dispense process is running, the controller can use liquid flowing back from the dispenser 104 in recirculation line 156 to collapse the vapor pressure in the tank if there is sufficient sub-cooling. The controller determines in step 640 if the bottom tank liquid pressure is greater than 6_PSI_COMPRESSED_PRESSURE, in order to determine whether the sub-cooled liquid can be used to collapse some of the gas pressure. If the bottom tank liquid pressure is greater than 6_PSI_COMPRESSED_PRESSURE, the controller executes step 642 and turns on the output to the pressure collapsing valve 119 to open the valve, and turns off, if they are not already turned off, the outputs to the recirculation shut-off valve 148 and the pressure building valve 196 to close these valves. Liquid flowing from the dispenser 104 through recirculation line 156 is then directed to the top of the tank to cool the gas in the tank and collapse pressure. The controller then returns to step 602.

If there is insufficient sub-cooling at step 640 to permit collapsing of the liquid without the risk of taking the liquid out of saturation, the controller executes step 644 to ensure that the recirculation shut-off valve 148 is open by turning on the output to the valve and that the pressure collapse valve 149 is closed by turning off the output to that valve. The controller then moves to step 646.

The controller executes step 646 if there is not sufficient sub-cooling for collapsing the vapor pressure. At step 646, the controller determines from a flag set during the dispense process in FIG. 7, FUELING_IN_PROGRESS, whether fueling of a vehicle is taking place. If it is, fueling is allowed to continue so as not to interrupt the fueling with a blow-down process that would cause the liquid to come out of saturation. The output to pressure building valve 196 is turned off at step 648 to close the valve in case it is still open and the controller returns to step 602. Continued fueling is permitted because it could lower the vapor pressure by reducing liquid volume in the tank. Continued fueling is not dangerous. The 63 PSIG limit is far enough below the maximum safe tank pressure that continued fueling of a vehicle is not likely to take it up to that point. Fueling additional vehicles while the tank is in this condition will not be possible because of the frequency with which process 600 repeats. At some point, fueling will stop and the process will move immediately to step 650 to stop the dispense process of FIG. 7 and begin a blow-down process.

The blow-down process begins at step 652 by blanking out display 173 and writing the message to the customer to wait for tank conditioning. During blow-down, pumping of liquid is stopped by setting the PID loop to manual mode and the pump speed output to the electric motor driving the pump to 4, turning off the pump. To prepare for blow-down at step 656, several valves are closed by turning off the outputs to those valves: pressure building valve 196; pump outlet valve 144; and pressure collapse valve 149. The outputs to the pump inlet valve 134, recirculation shut-off valve 148 and pump recirculation valve 146 are turned on, if not already on, to open the valves for allowing liquid to flow down into the pump and back through lines 138B and 156A. Tank blow-down valve 194 is then opened to vent gas from the top of tank 102 into a gas collection line. Blow-down continues at decision step 658 until the sensed temperature of the liquid, stored as the variable LIQUID_TEMP in process 400, falls to at least −230° Fahrenheit. This temperature can vary based on the maximum allowable tank pressure. This temperature is 30 degrees below the maximum liquid saturation temperature at 100 PSIG. The blow-down valve is then closed at step 660. The controller then resets the TRIP_1 variable to 0 at step 662 and prints the message onto the display port for communication to display 173 that tank conditioning is in progress at step 618 before returning to step 620.

To briefly summarize the tank conditioning process illustrated by the flow diagram of FIG. 6, the tank is placed in a storage mode when the controller is first powered up and when the system is shut down. In the storage mode, the pump is turned off and all valves are closed, except the pump inlet and recirculation valves to allow liquid to enter the pump and keep it cool to minimize flashing when first turned on. When fueling is desired, the start switch on the dispenser unit, is pushed. The controller enters the conditioning mode and brings the pressure of the liquid in the tank into a desirable operating and maintains it. If the pressure of the liquid at the bottom of the tank is not initially above 5 PSI, pressure is built by circulating the liquid through a heat exchanger coil until it the liquid pressure is at least 5 PSI and compressed at least 3 PSI beyond the saturation pressure. If the pressure is initially above 63 PSI and at least 6 PSI above the saturation pressure, pressure is collapsed by recirculating liquid to the top of the tank, until the pressure of the liquid at the bottom of the tank drops to 6 PSI above saturation pressure. Otherwise, if the liquid is not at least 6 PSI above saturation, vapor must be vented from the tank to relieve pressure and drop the temperature of the liquid. If fueling is taken place, it is allowed to finish before vapor is vented from the tank during this "blow down."

Once the pressure of the liquid in the tank is above pressure plus 3 PSI, it is allowed to increase up to 10 PSI above the saturation pressure before vapor pressure is collapsed by recirculating sub-cooled liquid to the top of the tank. The recirculation to the top of the tank is stopped once the pressure falls to 6 PSI to ensure that pressure does not fall below 3 PSI above the saturation pressure, which would cause the valve to the pressure building coil to open and build pressure and leading to unnecessary introduction of heat into the system. If the liquid pressure falls to below 3 PSI above saturation, liquid is passed through the coil to be turned into vapor to pressurize the tank. While the tank is in the conditioning mode, the actual pressures or set points for the 3, 6 and 10 PSI compression pressures are regularly determined by the process of FIG. 4, based on the current condition of the methane as measured by the temperature sensor.

Turning now to FIGS. 1 and 7, the dispense process 700 begins at the start block. The controller first determines at step 702 whether nozzle 162 is coupled to receptacle 178 on the dispenser 104 by looking at an input from sensor switch 184 at step 702. If it is not on, and if the Message 8 variable is 0 at step 704, the Message 8, "Attach Nozzle to Dispenser", is printed at step 706 to the display port for communication to display 173. The Message 8 variable is then set to 1. This directs the customer to replace the nozzle on the dispenser. The controller waits until the nozzle is replaced so that it can begin a cool-down process, and sets the Message 8 variable to "0" at step 708.

Beginning at step 710, the controller waits for the customer to push or turn on a cool-down button, one of the plurality of switches 177 on the dispenser. At step 712, if the nozzle has been taken off the receptacle prior to pushing the cool-down button, the processor returns to step 706 to display the message to replace the nozzle and to wait for replacement of the nozzle. A Message 6 variable is set at step 714 to 0 before returning to step 706. At step 718, the controller sends a message to the display port for transmission to the display 173 to inform the customer to press the cool-down switch to start fueling and to set the Message 6 variable to 1, if the Message 6 variable is 0 at step 716.

Once the cool-down switch is turned on, the Message 6 variable is set equal to 0 at step 720, and the controller executes steps to begin a flow of liquid through the nozzle for cooling it down. At step 722, pump outlet valve 144 is opened and pump recirculation or cool-down valve 146 and the pressure collapse valve 149 are closed. At step 726, message 7.1 "COOL-DOWN IN PROGRESS" is written to display 173. The controller then enters a cool-down process loop for a period of 180 seconds, until Time 2 equals zero at decision step 727. At step 731, the controller temporarily suspends operation of the tank conditioning process of FIG. 6, as operations carried out by the chart may conflict with cool-down process. The pressure collapse valve 149 is then opened and the recirculation shut off valve 148 is closed. The pump 131 is then turned on and run a constant low speed at step 733 by setting the PID loop controller to manual mode and the pump rate output to 12 (a relatively low speed). The low speed is sufficient to move liquid into the nozzle to cool it down, and while avoiding excessive circulation that undesirably introduces more heat into the LNG system. The pump TRIP flag is set to 1 at step 733 so that steps 731–755 are not operated following decision step 727. At steps 735 and 737, the number of minutes and seconds left for cool-down are written to the display 173. After a delay of one second, the controller checks at step 739 the input from the nozzle location sensor to see if the nozzle has been removed. If it remains attached to receptacle 178 and, as indicated by decision step 741, and the cool-down timer TIME 2 does not equal 30, the process returns to decision step 727. When TIME 2 is 30 seconds, the tank conditioning process in FIG. 6 resumes at step 743, before the return to step 727. If the nozzle has been removed by a user at decision step 739, which is prior to the cool-down, the controller executes step 745 to turn off the pump and then return to step 708 to instruct the user to return to nozzle to the receptacle 178.

At decision step 730, the controller checks an input from a liquid sensor 186. If liquid is sensed, cool-down is complete, and the controller proceeds to step 732. Otherwise, the process turns off an output to a cool-down light on the dispenser at step 734 in the event that it may be on, and then checks at step 736 whether the input from sensor switch 184 is on. If the nozzle sensor switch is still off, indicating the nozzle is in place on the dispenser (the switch is turned off when the nozzle is on the dispenser), the controller continues in the loop formed by steps 730 and 736 until cool-down is complete or the nozzle is taken off the dispenser. If the nozzle is taken of the dispenser, the processor executes steps 738 and 740 in which it diverts flow of liquid to the recirculation line, away from the nozzle, and displays a message to reattach the nozzle to the dispenser. Alternatively, the pump is turned off. At step 742, the controller waits until the input from the sensor switch 184 is received before proceeding to step 744 in which it turns off the output to diverter valve 160 to redirect the flow of liquid back to line 158.

Once cool-down is complete, the controller then instructs and waits for the customer to remove the nozzle from the dispenser, to couple it to a receptacle on a vehicle and to turn on a fueling button, one of the plurality of switches 177. At step 746, a trip counter variable, TRIP_2, and a Message 10 variable are both set equal to 0. If the nozzle has been taken off the dispenser at step 748, the controller begins, after setting the Message 10 variable to 0 at step 750, a pre-fueling routine in step 752. A timer is set equal to 90 seconds. The output to the diverter valve 160 is turned on to shift the flow of liquid temporarily to the recirculation line 156. The counter for the gas flow meter 170 is reset and then started.

At decision step 754, the controller checks the input from the fueling button. If it is not on and at step 756, the 90 second timer has not expired, the controller sends to the display 173 a message to the customer to press the fueling button to begin fueling at step 758. The Message 11 variable is set to 1 so that step 758 is bypassed at decision step 760 to prevent the message from blinking. The controller then waits for the fueling button to be pushed, or until 90 seconds expire. Once the timer expires, the Message 11 variable is set to 0 at step 762 and the process returns to step 738 to begin the nozzle cool-down process again. It is presumed that after 90 seconds, the nozzle has become too warm and therefore there is a risk of flashing of the liquid as it initially enters the nozzle during a fueling.

Once the fueling button is pushed by the customer, the Message 11 variable is set equal to 0 at step 764 and the controller checks the input from the nozzle sensor switch 184 at decision step 766 to make sure that the nozzle has not been reattached to the dispenser receptacle 178. If it has been reattached, the controller turns off the output to the diverter valve to close the valve for allowing fluid to flow through the nozzle, sets a third timer to 10 seconds, and sets the variable TRIP_2 to 1 in step 768. The controller then writes to the display port, at step 770, Message 10 to instruct the customer to attach the nozzle to a vehicle and sets the Message 10 variable equal to 1. The processor then returns to step 748. At this point, the customer has ten seconds to remove the nozzle from the dispenser.

If the nozzle sensor is attached to the receptacle 178 at step 748, the processor moves to decision step 772. If the variable TRIP_2 is 0, this means that the nozzle has not been removed, the fueling button turned on and the nozzle replaced since the last fueling. The processor then simply waits until the nozzle is removed after it has written Message 10 to the display, advising the customer to remove the nozzle as shown by decision step 774 and step 770. However, if the TRIP_2 variable is 1, then the processor checks the time remaining on Timer 3 at decision step 776. The processor continues to wait ten seconds for the nozzle to be removed, and then exits the loop formed by steps 772, 776, 774 and 748 to step 762, and from step 762 back to step 738 for the cool-down routine to begin again.

If the nozzle is removed at step 766, prior to Timer 3 expiring, a fueling routine takes place. At step 778, a Message 12, Fueling In Progress, is displayed as well as the dispensed amount nomenclature. At step 780, the liquid flow meter counter is reset and started and the diverter valve is closed, allowing liquid to flow to the nozzle through line 158. The PID loop for controlling the speed of the electric motor driving pump 131 is enabled for auto mode. A No Flow Timer is then set to ten seconds and a Fueling In Progress flag is set to true, the value −1 equaling true.

Step 782 calculates a running total of the amount of liquid dispensed by getting a counter value from the gas flow meter 170 and a counter value from the liquid flow meter 154. The processor subtracts from the liquid count the gas count and divides by 100 to adjust for the methane lost through the vent line 167 and returned to the tank 102. The result is thus an accurate measurement of the total amount (in lbs.) of liquid methane in the vehicle's tank. The processor converts the value to a character string for sending to the display 173, converts the measurement in lbs. to a measurement in gallons, converts the gallons value to a character string for sending to the display 173, blanks the display 173 and then sends the total character string to the display at step 784.

Steps 782 and 784 are repeated in a loop until the No Flow Timer is less than or equal to 0 at decision step 786. The processor then adds decision steps 788 and 789 to the loop and begins to check whether the tank is full by checking the fuel flow rate and whether the nozzle is on the dispenser. So long as the rate is above the minimum rate and the nozzle is on the dispenser, fueling continues and the loop repeats. As previously described, "velocity fuse" 176 in the vent line of the nozzle closes when a flow of liquid enters the vent line. Closing of the fuse significantly reduces the liquid flow rate and vapor flow rate. The processor waits ten seconds before executing decision 788 to ensure that variations in the fuel flow rate at the initiation of dispensing does not cause a premature shutdown. Alternately, the gas flow meter can also be monitored at step 788 to determine when vapor flow rate in the vent line falls to below a minimum rate. If a liquid sensor is used in the vent line in the nozzle to sense liquid, the processor checks an input from the liquid sensor at step 788. The No Flow Timer may have to be adjusted when a liquid sensor is used to permit enough time for liquid in the vent line to clear at the beginning of dispensing and thus avoid spurious indications.

Once the tank is full, fueling ends by turning on the output to diverter valve 160 to switch the valve toward recirculation line 156. The PID pump controller is placed in the manual mode and the pump run at a slow speed (which is indicated by the valve "12"), to slowly circulate liquid through the line to the dispenser to keep the line and the dispenser cool. The fueling in progress variable is then set equal to 0 to remember that fueling has been completed. The processor begins printing at step 790 a receipt on a printer at the dispenser 104. The customer is reminded at step 794 to replace nozzle on receptacle 178 by the processor writing Message 13 to the display 173. Once the nozzle in on the receptacle, the diverter valve output is turned off to direct the flow of liquid through the nozzle to keep it cool, as indicated by steps 796 and 797. It then returns, after a delay of three seconds, to step 730 where the cool down conditions are rechecked. If the conditions are still satisfied from the previous fueling, subsequent fuel can immediately take place.

Referring now to FIGS. 1 and 8, a shut-down routine 800 turns off dispensing and places the tank in a storage mode. It begins, as indicated by step 801, by presetting a shutdown timer to 3600 seconds, and then, at steps 802 and 803, the controller checks to see if the stop switch has been depressed and then released. The dispense process 700 is then stopped at step 804. The dispense process is also stopped if the stop switch is not on, the FUELING_IN_PROCESS flag is false, and the shutdown timer has expired. If the Fueling In Progress flag is true at step 806, the processor finishes printing a receipt, as indicated by step 808. At step 810, the processor turns off pump 131 by disabling the PID loop and the analog point output. The pump recirculation valve 146 is opened. The outputs to the pump outlet valve 144, cool-down light and diverter valve are turned off to close these valves. Several message flags are cleared at step 811 and the tank storage mode flag is then set at step 812 to "−1" to indicate true.

Although preferred embodiments of the invention have been described and are illustrated in the accompanying drawings, it will be understood that the invention is not limited to the embodiments disclosed, but is capable of numerous rearrangements, modifications, and substitutions of parts and elements without departing from the spirit of the invention. Accordingly, the present invention is intended to encompass such rearrangements, modifications, and substitutions of parts and elements as fall within the scope of the invention as set forth in the appended claims.

What is claimed is:

1. A method of automatic operation of a facility for dispensing cryogenic liquid fuel into a motor vehicle through a dispenser system from a supply stored in a cryogenic storage tank comprising the steps of:

measuring pressure of the liquid fuel stored in a cryogenic tank with a pressure sensor and communicating a signal indicative of the pressure to a controller;

measuring temperature of the liquid fuel in the cryogenic tank with a temperature sensor and communicating a signal indicative of the temperature to the controller;

determining with the controller, in response to the signal indicative of temperature, a first set pressure for the liquid fuel greater than a liquid saturation pressure for the liquid fuel at the indicated temperature; and enabling with the controller the dispenser system to permit a user to dispense on demand liquid fuel into a vehicle only if a signal from the pressure sensor indicates that the pressure of the liquid fuel is substantially at or above the first set pressure, thereby tending to assure that homogeneous phase liquid fuel is dispensed into a motor vehicle.

2. The method of claim 1 wherein the facility for dispensing liquid fuel includes a centrifugal pump for pumping liquid fuel from the cryogenic tank and wherein the set pressure is equal to or greater than the sum of the liquid saturation pressure at the indicated temperature and a compression pressure for compensating for at least an expected loss of pressure between the tank and a centrifugal pump.

3. The method of claim 1 further comprising the step of the controller communicating to a pressure building means in response to a signal from the pressure sensor indicating that the pressure of liquid fuel is below the set pressure to build vapor in the top of the cryogenic tank to compress the liquid fuel to the set pressure.

4. The method of claim 1 further comprising the step of the controller opening a valve to vent fuel gas from the cryogenic tank in response to a signal from the pressure sensor indicating that the pressure of the liquid fuel is greater than a predetermined maximum safe pressure.

5. The method of claim 4 wherein the step of enabling includes the step of the controller not enabling the dispenser system to begin dispensing if a signal from the pressure sensor indicates that the pressure of the liquid fuel is above the predetermined maximum safe pressure.

6. The method of claim 1 further including the step of the controller causing liquid to circulate from the bottom of the tank to the top of the tank to cool vapor collecting in the top of the tank and reduce the pressure exerted by the vapor when the pressure within the hank exceeds a second set pressure greater than the first set pressure.

7. The method of claim 6 wherein the controller circulates the liquid from the bottom of the tank to the top of the tank until the pressure of the tank drops to a third set pressure, between the first and the second set pressures.

8. The method of claim 7 wherein the controller regularly updates the first, second and third set pressures during operation of the facility to reflect changes in temperature of the liquid fuel in the tank as indicated by the signal from the temperature sensor.

9. The method of claim 1 wherein the controller regularly updates the first set pressure during operation of the facility to reflect change in conditions of the fuel in the tank indicated by the signal from the temperature sensor.

10. A method of automatic operation of a facility for dispensing cryogenic liquid fuel into a motor vehicle through a dispenser system from a supply stored in a cryogenic storage tank comprising the steps of:

measuring pressure of the liquid fuel stored in a cryogenic tank with a pressure sensor and communicating a signal indicative of the pressure to a controller;

measuring temperature of the liquid fuel in the cryogenic tank with a temperature sensor and communicating a signal indicative of the temperature to the controller;

determining with the controller, in response to the signal indicative of temperature, a first set pressure for the liquid fuel greater than a liquid saturation pressure for the fuel at the indicated temperature and second set pressure greater than the first set pressure and less than a maximum safe pressure; and maintaining with the controller the pressure of the liquid fuel within an operating range between first and second set pressures, the controller communicating to a pressure building means in response to a signal from the pressure sensor indicating that the pressure of liquid fuel is below the set pressure to build vapor in the top of the cryogenic tank to compress the liquid fuel to the set pressure, and by the controller causing liquid to circulate from the bottom of the tank to the top of the tank to cool vapor collecting in the top of the tank and reduce the pressure exerted by the vapor when the pressure within the tank exceeds the second set pressure.

11. The method of claim 10 wherein the controller regularly updates the first set pressure during operation of the facility to reflect changes in condition of the fuel in the tank as indicated by the signal from the temperature sensor.

12. The method of claim 10 wherein the controller causes the liquid to stop circulating from the bottom of the tank to the top of the tank when the pressure of the tank drops to a third set pressure, between the first and the second set pressures, to prevent the pressure building means from turning on unnecessarily.

13. A facility for dispensing a cryogenic liquid fuel into a motor vehicle through a dispenser system from a supply stored in a cryogenic storage tank comprising:

a cryogenic tank for storing a supply of cryogenic liquid fuel;

pressure building means for turning the liquid fuel to vapor;

means to circulate liquid fuel to the top of the tank to cool vapor collecting in the top of the tank and thus collapse pressure exerted on liquid in the bottom of the tank;

a controller;

a pressure sensor for sensing pressure of the liquid fuel stored in a cryogenic tank and communicating a signal indicative of the pressure to the controller;

a temperature sensor for sensing temperature of the liquid fuel in the cryogenic tank and communicating a signal indicative of the temperature to the controller;

wherein the controller is enabled to determine, in response to the signal indicative of temperature, a first set pressure for the liquid fuel greater than a liquid saturation pressure for the liquid fuel at the indicated temperature and second set pressure greater than the first set pressure and less than a maximum safe pressure for the tank; and wherein the controller is further programmed to maintain the pressure of the liquid fuel between the first and second set pressures by causing, in response to a signal from the pressure sensor indicating that the pressure of liquid fuel is below the first set pressure, the pressure building means to build vapor in the top of the cryogenic tank to compress the liquid fuel to at least the first set pressure, and by causing the means to circulate liquid to circulate from the bottom of the tank to the top of the tank to cool vapor collecting in the top of the tank and reduce the pressure exerted by the vapor when the pressure within the tank exceeds the second set pressure.

14. The method of claim 13 wherein the controller regularly updates the first set pressure during operation of the facility to reflect changes in condition of the fuel in the tank as indicated by the signal from the temperature sensor.

15. The method of claim 13 wherein the controller causes the liquid to stop circulating from the bottom of the tank to the top of the tank when the pressure of the tank drops to a third set pressure, between the first and the second set pressures.

16. A method of maintaining a supply of cryogenic fluid in automatic operation of a facility for dispensing cryogenic fluid through a dispenser system from a supply stored in a cryogenic storage tank comprising the steps of:

receiving a supply of cryogenic fluid in a saturated state and under pressure in a storage tank; and compressing the cryogenic fluid to at least a predetermined first set pressure greater than the cryogenic liquid's current saturation pressure but below a maximum pressure of the storage tank, the first set pressure assuring that the cryogenic fluid is sub-cooled to absorb heat while minimizing vaporization, thereby avoiding venting of vapor when the pressure in the storage tank reaches the maximum pressure;

wherein the step of compressing includes the step of trapping vapor in the top of the storage tank to apply pressure to the liquid, and the step of relieving pressure of the vapor in the top of the storage tank when the liquid pressure exceeds a second set pressure greater than the first set pressure but less than the maximum pressure.

17. The method of claim 16 further including the step of updating the first set pressure on a continuing basis to reflect changes of temperature of the liquid fuel in the cryogenic tank due to heating to maintain the cryogenic liquid in a sub-cooled condition.

18. The method of claim 16 further comprising the step of filling the storage tank from its bottom with cryogenic fluid from a supply of cryogenic fluid delivered in a saturated state and under pressure while minimizing loss of the pressure under which the cryogenic fluid is placed; and the step of relieving pressure includes the step of redirecting filling of the storage tank to the top of the storage tank, the cryogenic liquid tending thereby to cool vapor collected in the top of the storage tank, reducing pressure on the cryogenic liquid.

19. The method of claim 16 wherein the step of compressing further includes the steps of:

measuring pressure of the liquid fuel in the cryogenic tank with a pressure sensor and communicating a signal indicative of the pressure to a controller;

measuring temperature of cryogenic fluid in the cryogenic tank with a temperature sensor and communicating a signal indicative of the pressure to the controller;

determining with the controller, in response to the signals indicative of temperature and pressure, the first set pressure.

20. A facility for selectively dispensing liquid fuel from a cryogenic storage tank and into a second tank, the facility comprising:

a cryogenic tank for storing a supply of a liquid fuel for dispensing in selected quantities;

pressure and temperature sensors in fluid communication with the liquid fuel in the tank for sensing the pressure and temperature of the liquid and transmitting signals indicating the pressure and temperature;

a pump for pumping cryogenic liquid from the pump to a dispenser;

a dispenser including a nozzle which an individual couples to the second storage tank for dispensing liquid fuel;

a valve for enabling dispensing of the liquid through the dispenser;

an electronic controller for executing a control process to determine conditions under which liquid fuel will be dispensed; the controller including inputs for receiving signals indicating conditions in the storage tank and the status of the dispenser, and in response thereto providing signals on outputs for providing signals to open and close the valve; and a display device adjacent the dispenser, the display device receiving signals from an output of the electronic controller carrying messages for display to the individual for operating the dispenser.

21. The facility of claim 20 further comprising sensors for sensing vapor fuel around the facility and transmitting a signal to the electronic controller, wherein the electronic controller stops dispensing of liquid fuel through the dispenser.

* * * * *